US006732614B2

(12) United States Patent
Hu

(10) Patent No.: US 6,732,614 B2
(45) Date of Patent: May 11, 2004

(54) EASY-TO-MANUFACTURE AND EASY-TO-ASSEMBLE RATCHETING-TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/854,795

(22) Filed: May 14, 2001

(65) Prior Publication Data

US 2002/0112573 A1 Aug. 22, 2002

(30) Foreign Application Priority Data

Feb. 19, 2001 (TW) ..... 90202563 U

(51) Int. Cl.[7] ..... B25B 13/46
(52) U.S. Cl. ..... 81/63.2; 81/60
(58) Field of Search ..... 81/63.2, 63, 63.1, 81/62, 60, 61, 58.4

(56) References Cited

U.S. PATENT DOCUMENTS

| | | | | |
|---|---|---|---|---|
| 15,482 A | | 8/1856 | Gilman | |
| 810,599 A | | 1/1906 | Ansorge | |
| 841,686 A | | 1/1907 | Hatfield | |
| 893,097 A | | 7/1908 | Reams | |
| 915,446 A | | 3/1909 | Kearnes | |
| 1,033,358 A | | 7/1912 | Turner | |
| 1,194,471 A | | 8/1916 | Boosinger | |
| 1,261,092 A | | 4/1918 | Allen | |
| 1,382,492 A | | 6/1921 | Evans | |
| 1,426,127 A | | 8/1922 | Tuttle | |
| 1,614,039 A | | 1/1927 | Mandl | |
| 1,957,462 A | | 5/1934 | Kress | |
| 2,317,461 A | | 4/1943 | Jackson | |
| 2,542,241 A | | 2/1951 | Fors | |
| 2,657,604 A | | 11/1953 | Rueb | |
| 2,701,977 A | * | 2/1955 | Stone | 81/63.2 |
| 2,764,048 A | | 9/1956 | Thompson | |
| 2,769,360 A | | 11/1956 | Cottrell et al. | |
| 2,800,821 A | | 7/1957 | Fruscella | |
| 2,891,434 A | | 6/1959 | Lozensky | |
| 2,957,377 A | * | 10/1960 | Hare | 81/63.2 |
| 3,019,682 A | | 2/1962 | Hare | |
| 3,250,157 A | | 5/1966 | Badger | |
| 3,265,171 A | * | 8/1966 | Kilness | 81/63 |
| 3,337,014 A | | 8/1967 | Sandrick | |
| 3,393,587 A | | 7/1968 | Jolliff et al. | |
| 3,393,780 A | | 7/1968 | Kilness | |
| 3,436,992 A | | 4/1969 | Over et al. | |
| 3,577,816 A | | 5/1971 | Alexander et al. | |
| 3,713,356 A | | 1/1973 | Knudsen | |
| 3,742,788 A | | 7/1973 | Priest | |
| 3,838,614 A | | 10/1974 | O'Donnell | |
| 3,908,487 A | | 9/1975 | Plaw | |
| 4,070,932 A | | 1/1978 | Jeannotte | |
| 4,111,077 A | | 9/1978 | Cummings et al. | |
| 4,128,025 A | | 12/1978 | Main et al. | |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—Hadi Shakeri
(74) *Attorney, Agent, or Firm*—Alan Kamrath; Rider Bennett, LLP

(57) ABSTRACT

A wrench comprises a handle and a head extended from the handle. A web is defined between the handle and the head. The head includes a compartment in which a drive member is rotatably received. The web includes a transverse through-hole having an intermediate portion communicated with the compartment. A cavity is defined in the web and communicated with the transverse through-hole. A switch member is mounted in the cavity and rotatable relative to the handle between two positions corresponding to two opposite ratcheting directions of the handle. A pawl is slidably mounted in the transverse through-hole for engaging with the drive member. The pawl remains in the transverse through-hole during operation.

12 Claims, 26 Drawing Sheets

U.S. PATENT DOCUMENTS 4,274,311 A 6/1981 Ebert
4,277,989 A 7/1981 Tracy
4,277,990 A 7/1981 Hall
4,308,768 A 1/1982 Wagner
4,308,769 A 1/1982 Rantanen
4,328,720 A 5/1982 Shiel
4,336,728 A 6/1982 Diebert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A * 2/1991 Lee ..... 881/60
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Hsieh
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,216,563 B1 * 4/2001 Hsieh ..... 81/63.2
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,301,998 B1 10/2001 Hu

* cited by examiner

EASY-TO-MANUFACTURE AND EASY-TO-ASSEMBLE RATCHETING-TYPE WRENCH

BACKGROUND OF THE INVENTION

1. Field of the Invention

The present invention relates to an easy-to-manufacture and easy-to-assemble ratcheting-type wrench.

2. Description of the Related Art

Several factors are considered in designing wrenches and spanners, including improving the torque-bearing capacity, providing as many teeth as possible for the drive member, and providing an easy-to-manufacture structure. FIG. 20 of the drawings illustrates a conventional wrench of the type having a handle B' and a head in which a drive member A' is rotatably received. A pawl D' is slidably received in a transverse through-hole C' in a web between the handle B' and the head. However, an end of the pawl D' extends beyond the transverse through-hole C' and thus adversely affects operation of the wrench when used in a limited space. A two-pawl type wrench was proposed to solve this problem. As illustrated in FIGS. 21 through 23, the two-pawl type wrench includes a handle 1' and a head 11' extended from the handle 1'. A drive member 2' is rotatably received in the head 11', a receptacle 12' is defined in a web between the handle 1' and the head 11', and a spring-biased switch member 4' is mounted in a cavity 13' in the web. Two spaced pawls 3' are received in the receptacle 12' and are biased by two springs 6', respectively. A threaded end cap 5' is engaged with a threaded outer end 121' of the receptacle 12' to enclose the pawls 3' and springs 6'. As illustrated in FIGS. 22 and 23, the switch member 4' is turned to bias one of the pawls 3' to engage teeth 31' thereof with the drive member 2' to thereby change the ratcheting direction of the wrench. However, it was found that the switch member 4' cannot be reliably retained in place and thus tends to disengage from the cavity 13'. In addition, the pawl 3' engaged with the drive member 2' is not engaged with an inner longitudinal wall that defines the transverse through-hole and that faces the drive member 2'. As a result, the torque-bearing capacity of the wrench is poor. Furthermore, the outer pawl 3' (FIGS. 22 and 23) tends to get stuck when the threaded end cap 5' is mounted too close to the switch member 4'. On the other hand, if the threaded end cap 5' is too far away from the switch member 4', the pawl 3' cannot be firmly engaged with the drive member 2'. Further, the threaded end cap 5' tends to be disengaged from the web between the handle 1' and the head 11', as the former is in threading engagement with the threaded outer end 121' of the receptacle 12'.

FIGS. 24 through 26 illustrate another conventional wrench having a substantially V-shape transverse through-hole 25' in a web between a handle 20' and a head 21' thereof. The head 21' includes a compartment in which a drive member 22' is rotatably received. A spring-biased pawl 23' is received in each limb of the V-shape transverse through-hole 25'. A switch member 30' includes a stem 35' pivotally received in a cavity 24' in the web and a thumb-piece 32' extending from the stem 35' for manual operation, thereby switching the switch member 30' between two positions corresponding to two opposite ratcheting directions of the wrench. The thumb piece 32' of the switch member 30' includes a downwardly facing receptacle 36' (FIG. 26) for receiving a spring 37' and a ball 38' that is biased by the spring 37' to be positioned in one of two positioning recesses 281' (FIG. 25) in a sector-like recessed area 28' (FIG. 24) of the web. The switch member 30' may be retained in place reliably. However, a C-clip 33' is required for mounting the switch member 30' in place. In addition, processing of the sector-like recessed area 28' in the web and the V-shape transverse through-hole 25' is difficult. Mounting of the switch member 30' as well as the pawl 23' and associated springs 26' and threaded end caps 27' are troublesome and time-consuming. The sector-like recessed area 28' in the web results in an increase in the overall thickness of the wrench, which limits application of the wrench in limited spaces.

U.S. Pat. No. 6,282,991 discloses a biasing arrangement for a pawl of a reversible ratchet-type wrench. However, the pawl protrudes beyond the handle during change in the ratcheting direction and thus adversely affects operation of the wrench in a limited space, as the protruded portion of the pawl tends to impinge on an object in the limited space.

SUMMARY OF THE INVENTION

It is an object of the present invention to provide an easy-to-manufacture and easy-to-assemble ratcheting-type wrench.

In accordance with a first aspect of the invention, a wrench comprises:

- a handle comprising a first lateral side and a second lateral side opposite to the first lateral side;
- a head extended from the handle, a web being defined between the handle and the head, the head including a compartment, the web including a transverse through-hole having an intermediate portion communicated with the compartment, the transverse through-hole extending from the first lateral side to the second lateral side of the handle, a cavity being defined in the web and communicated with the transverse through-hole;
- a drive member rotatably mounted in the compartment of the head and including a plurality of teeth on an outer periphery thereof;
- a switch member mounted in the cavity and rotatable relative to the handle between two positions corresponding to two opposite ratcheting directions of the handle; and
- a pawl mounted in the transverse through-hole and slidable along a lengthwise direction of the transverse through-hole, the pawl including a side facing the compartment, the side of the pawl including a first toothed portion and a second toothed portion that are selectively engaged with the teeth of the drive member according to one of the positions of the switch member relative to the handle.

In accordance with a second aspect of the invention, a wrench comprises:

- a handle;
- a head extended from the handle, a web being defined between the handle and the head, the head including a first compartment, the web including a second compartment communicated with the first compartment, a cavity being defined in the web and communicated with the second compartment;
- a drive member rotatably mounted in the first compartment of the head and including a plurality of teeth on an outer periphery thereof;
- a switch member mounted in the cavity and rotatable relative to the handle between two positions corresponding to two opposite ratcheting directions of the handle; and
- a pawl slidably mounted in the second compartment, the pawl including a first side facing the first compartment and a second side facing away from the first compartment, the first side of the pawl including a first toothed portion and a second toothed portion that are selectively engaged with the teeth of the drive member according to one of the positions of the switch member relative to the handle, the second side of the pawl including a notch, the switch member having a portion extending into the notch of the pawl, thereby preventing disengagement of the switch member from the cavity.

The wrench in accordance with the present invention has a simple structure and is easy to assemble by using a C-clip without the need of any screws. In addition, the compartment, the transverse hole and the cavity can be processed by means of milling. No computer lathe is required. Thus, the cost is low, the manufacture process is short, and the production time is also short. Furthermore, the pawl will not protrude beyond the transverse through-hole. Inadvertent switching of the ratcheting direction is avoided. Further, the drive member is firmly engaged with and in intimate contact with the associated toothed portion of the pawl during ratcheting. The risk of slippage or so-called "teeth jump" is avoided. The second side of the pawl contacts with the inner longitudinal wall of the transverse through-hole by a larger area such that the wrench in accordance with the present invention may bear a higher torque. This also prevents inadvertent relative displacement between the biasing member and the pawl. The biasing member in the form of a coil spring provides smooth switching of the switch member, while the rigid pin provides an alternative option for the user. Further, a bridge is provided between the compartment and the cavity, which increases the strength of the wrench, thereby providing a higher torque-bearing capacity. Further, in accordance with the second aspect of the invention, the lower portion of the column extends into the notch of the pawl. Disengagement of the switch member from the cavity is prevented without using any additional elements.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
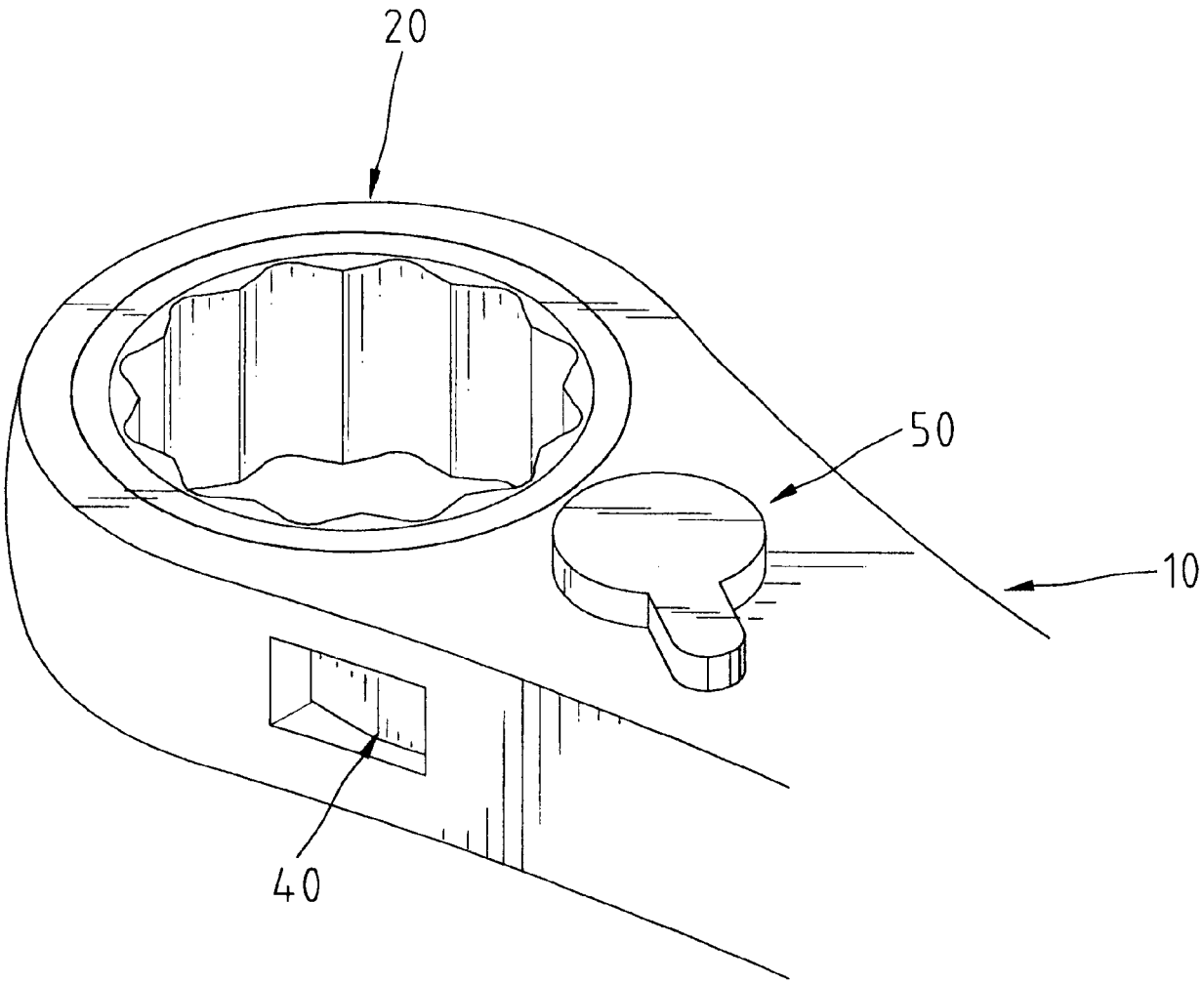
FIG. 1 is a perspective view of a portion of a wrench in accordance with the present invention.
Figure 2:
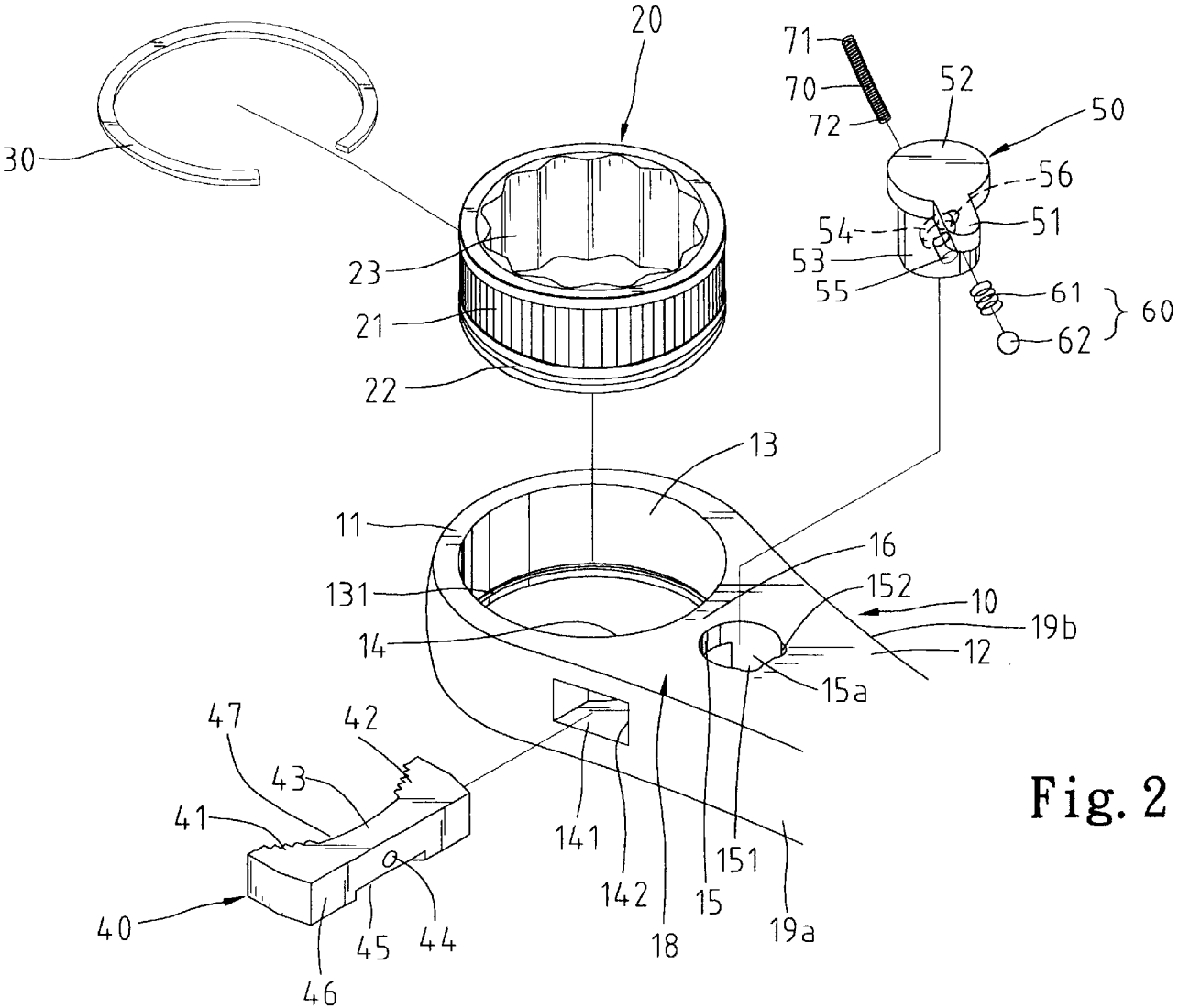
FIG. 2 is an exploded perspective view of the portion of the wrench in FIG. 1.
Figure 3:
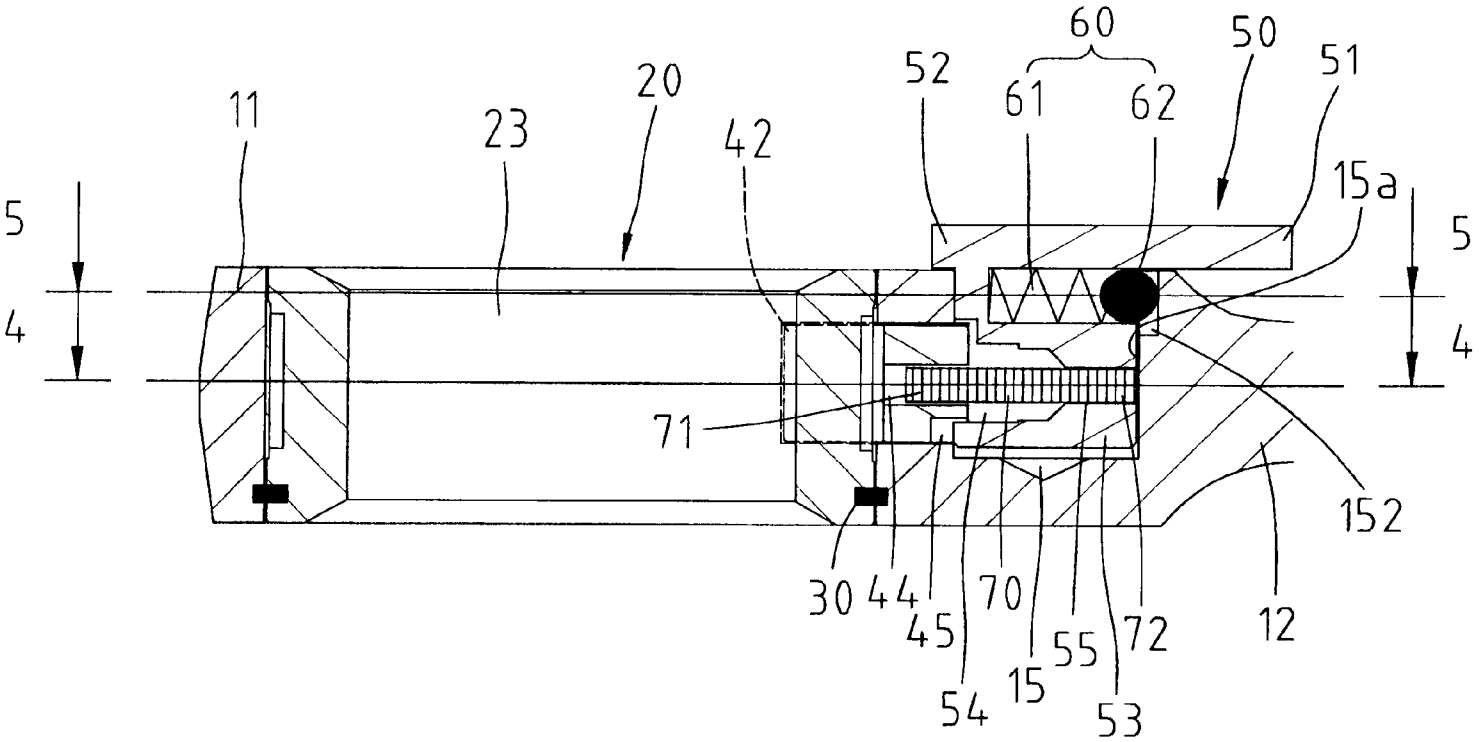
FIG. 3 is a sectional view of the portion of the wrench in FIG. 1.

Referring to FIGS. 1 through 4, a wrench 10 in accordance with the present invention generally includes a handle 12 and a head 11 extended from the handle 12, a web 18 being defined between the handle 12 and the head 11. The head 11 includes a compartment 13. A rectangular transverse through-hole 14 (FIG. 4) is defined in the web 18 and includes an intermediate portion communicated with the compartment 13. The transverse through-hole 14 extends from one lateral side 19*a* of the handle 12 to the other lateral side 19*b* of the handle 12, thereby defining an opening 141 in each of two ends thereof. The transverse through-hole 14 includes an inner longitudinal wall 142 that faces the compartment 13, which will be described later. The web 18 further includes a cavity 15 defined therein and communicated with the transverse through-hole 14. Referring to FIGS. 2 and 3, the cavity 15 includes a vertical portion 15*a* that extends upward to an upper side of the handle 12. Thus, a bridge 16 is formed on the upper side of the handle 12 and between the compartment 13 and the cavity 15. The vertical portion 15*a* of the cavity 15 includes a first positioning recess 151 and a second positioning recess 152. The first and second positioning recesses 151 and 152 can be processed by means of a conventional drilling or milling machine, which is very easy to manufacture.

A drive member 20 (in the form of a drive gear in this embodiment) is rotatably mounted in the compartment 13. The drive member 20 includes a plurality of teeth 21 on an outer periphery thereof and an annular groove 22 in a lower portion of the outer periphery thereof. A portion of the teeth 21 of the drive member 20 extends into the transverse through-hole 14, best shown in FIG. 4. The drive member 20 further includes a polygonal inner periphery 23 for engaging with a fastener, such as a nut or a bolt head. A C-clip 30 is engaged in the annular groove 22 of the drive member 20 and an annular groove 131 (FIG. 2) defined in a lower portion of an inner periphery defining the compartment 13, thereby rotatably mounting the drive member 20 in the compartment 13, best shown in FIG. 3.

Figure 4:
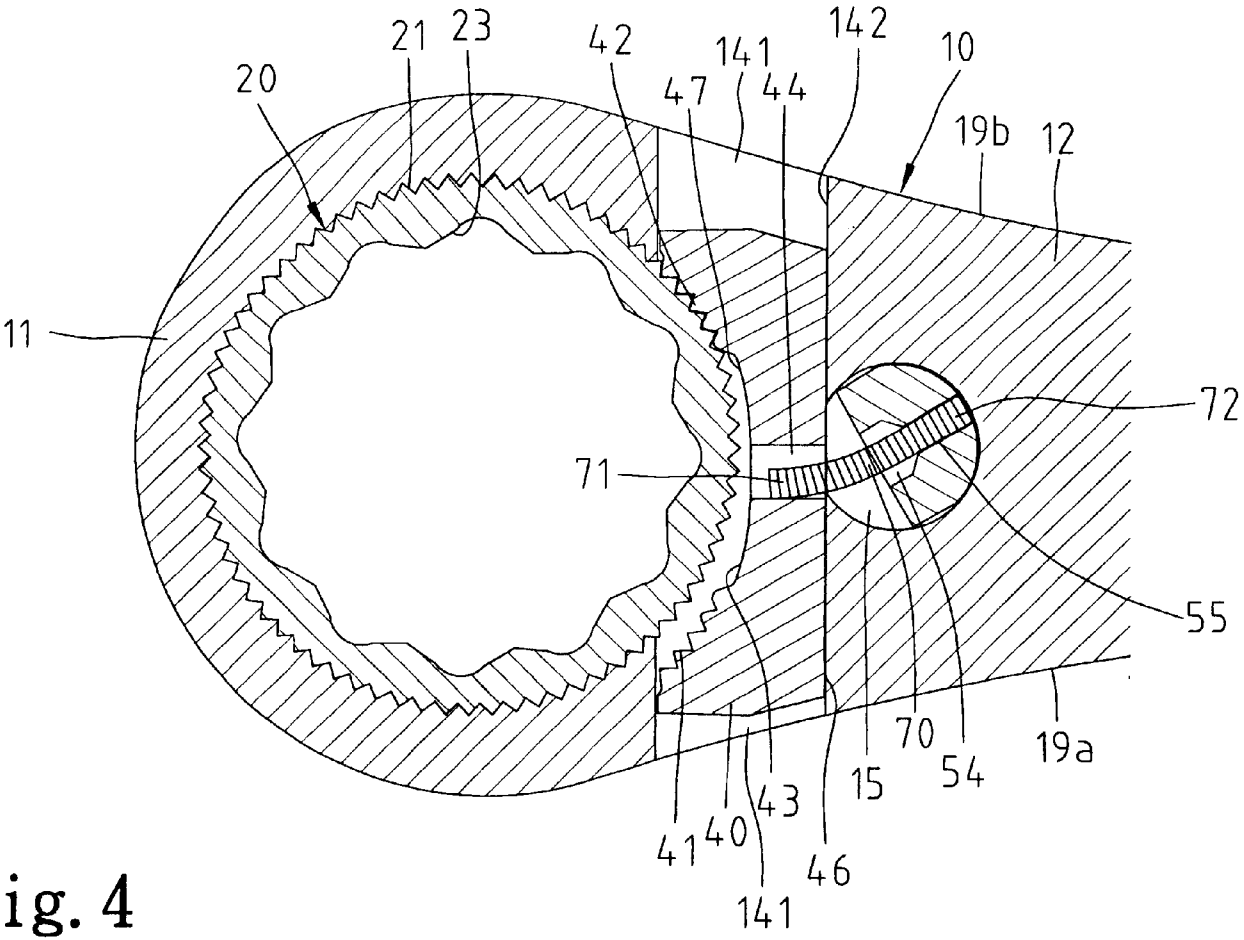
FIG. 4 is a sectional view taken along line 4—4 in FIG. 3.

A substantially rectangular pawl 40 is mounted in the transverse through-hole 14 and slidable along a lengthwise direction of the transverse through-hole 14. The pawl 40 includes a first lateral side 47 facing the drive member 20 and a second lateral side 46 facing away from the drive member 20. As illustrated in FIG. 4, the first lateral side 47 of the pawl 40 is preferably arcuate and includes a first toothed portion 41, a second toothed portion 42, and a recessed portion 43 between the first toothed portion 41 and the second toothed portion 42. The pawl 40 further includes a transverse hole 44 in an intermediate portion thereof. In addition, a notch 45 is defined in a lower portion of the second lateral side 46.

A switch member 50 is rotatably mounted in the vertical portion 15*a* of the cavity 15. In this embodiment, the switch member 50 includes an enlarged head 52 larger than a diameter of the vertical portion 15*a* of the cavity 15, a thumb piece 51 extended radially outward from the enlarged head 52 for easy manual operation by a user, and a column 53 extended downward from the enlarged head 52 and received in the vertical portion 15*a* of the cavity 15. The column 53 includes a first receptacle consisting of a first portion 54 adjacent to the transverse through-hole 14 and a second portion 55 distal to the transverse through-hole 14, the first portion 54 having a diameter greater than that of the second portion 55, best shown in FIG. 4. The column 53 further includes a second receptacle 56 extending at a level other than that of the first receptacle.

Figure 5:
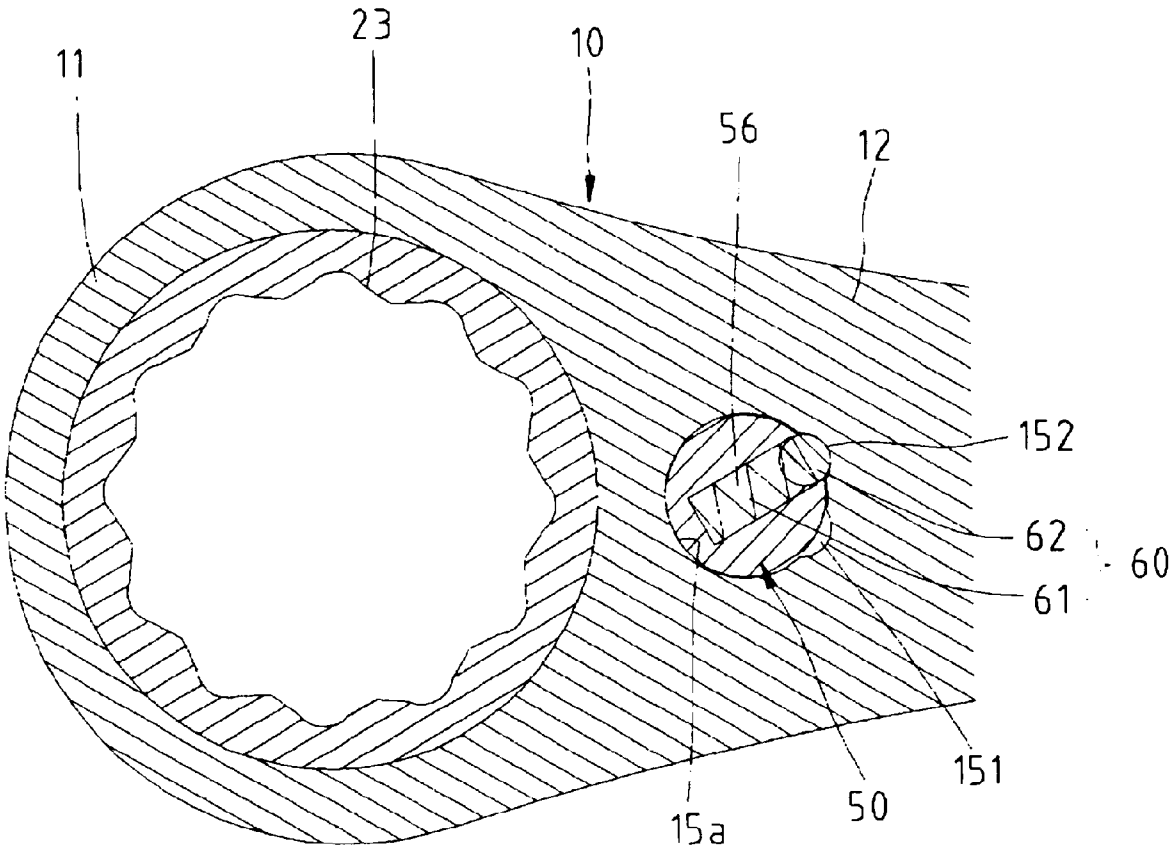
FIG. 5 is a sectional view taken along line 5—5 in FIG. 3.

As illustrated in FIG. 5, a positioning means 60 is provided for retaining the switch member 50 in place. In this embodiment, the positioning means 60 includes a spring 61 mounted in the second receptacle 56 of the column 53 and a ball 62 partially received in the second receptacle 56 and partially received in one of the positioning recesses 151 and 152 of the vertical portion 15*a* of the cavity 15. Referring to FIG. 4, a biasing member 70 (in the form of a coil spring) is mounted in the first receptacle of the column 53 and has a first end 71 extended into the transverse hole 44 of the pawl 40 and a second end 72 in the second portion 55 of the first receptacle.

In assembly, the ball 62 and the spring 61 are mounted into the second receptacle 56 of the switch member 50, which is then mounted into the cavity 15. The pawl 40 is inserted into the rectangular transverse through-hole 14 of the web 18 via an opening 141 of the transverse through-hole 14. The first side 47 of the pawl 40 faces the compartment 13. A lower portion of the column 53 extends into the notch 45 of the pawl 40 to prevent disengagement of the switch member 50 from the cavity 15. Next, the second end 72 of the biasing member 70 is inserted into the second portion 55 of the switch member 50 with the first end 71 of the biasing member 70 retaining in the transverse hole 44 of the pawl 40, best shown in FIGS. 3 and 4. Then, the C-clip 30 is mounted into the annular groove 22 of the drive member 20, which is then mounted into the compartment 13 of the head 11. The C-clip 30 expands outward into the annular groove 131 of the head 11, thereby rotatably mounting the drive member 20 in the compartment 13. It is noted that the assembly procedure can be accomplished easily and quickly without any screws or covers. In addition, referring to FIG. 3, the lower portion of the column 53 extends into the notch 45 of the pawl 40. Disengagement of the switch member 50 from the cavity 15 is prevented without using any additional elements.

In use, referring to FIGS. 4 and 5, when the ball 62 is engaged with the second positioning recess 152 of the switch member 50, the first end 71 of the biasing member 70 bears against a lower wall defining the transverse hole 44 of the pawl 40. The biasing member 70 exerts a force to the pawl 40 that can be imparted into a horizontal force parallel to the lengthwise direction of the pawl 40 and a vertical force that is normal to the horizontal force. If the handle 12 is turned clockwise, the drive member 20 is firmly engaged with the second toothed portion 42 of the pawl 40 under the action of the vertical force, thereby tightening or loosening the fastener (not shown) engaged in the polygonal inner periphery 23 of the drive member 20. A higher torque is provided, as the drive member 20 is firmly engaged with and in intimate contact with the second toothed portion 42 of the pawl 40. In addition, the force transmitted to the pawl 40 from the drive member 20 is distributed to the inner longitudinal wall 142 of the transverse through-hole 14 having a relatively large area. As a result, the wrench in accordance with the present invention may bear higher torque. The drive member 20 rotates freely when the handle 12 is turned counterclockwise.

Figure 6:
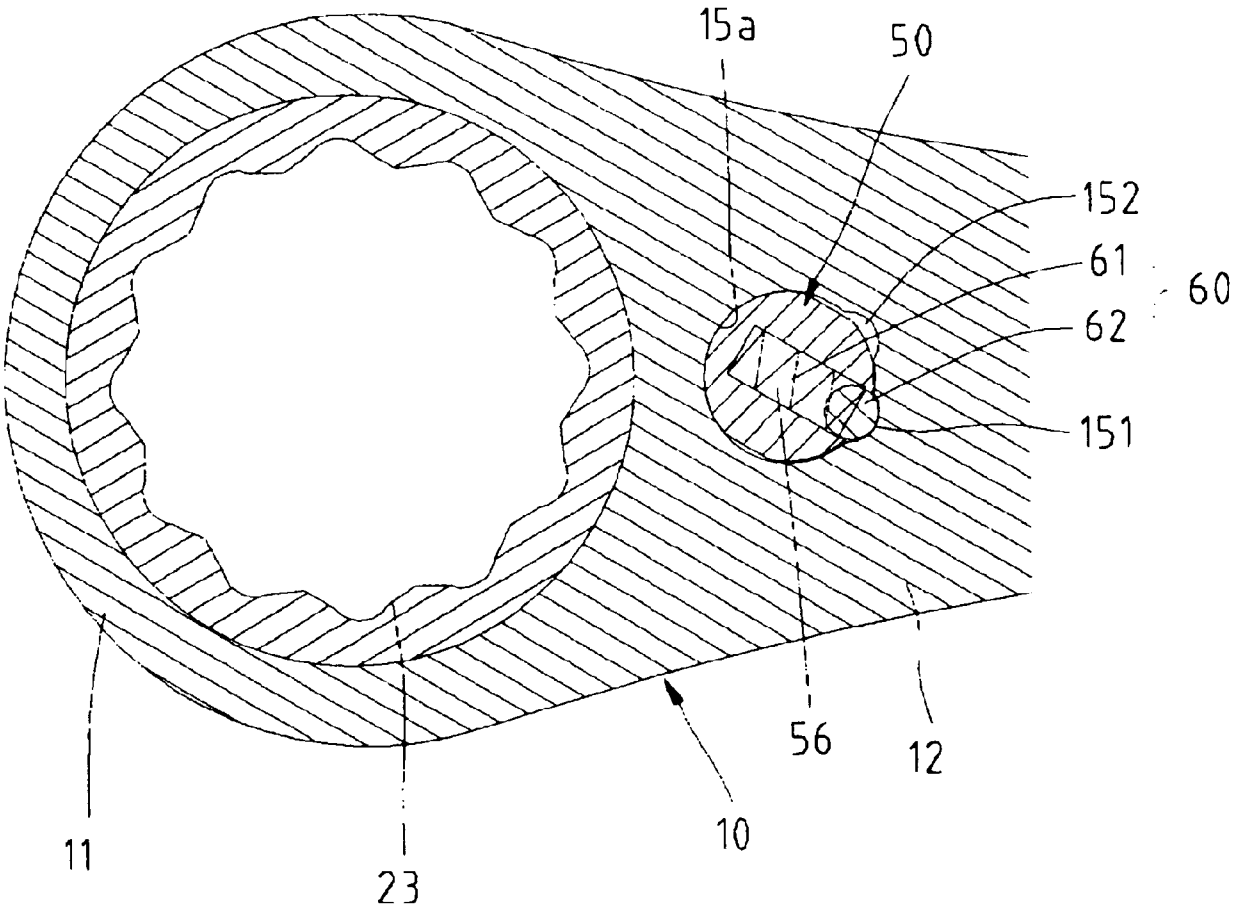
FIG. 6 is a view similar to FIG. 5, wherein the switch member is in a position for ratcheting in a reverse direction.
Figure 7:
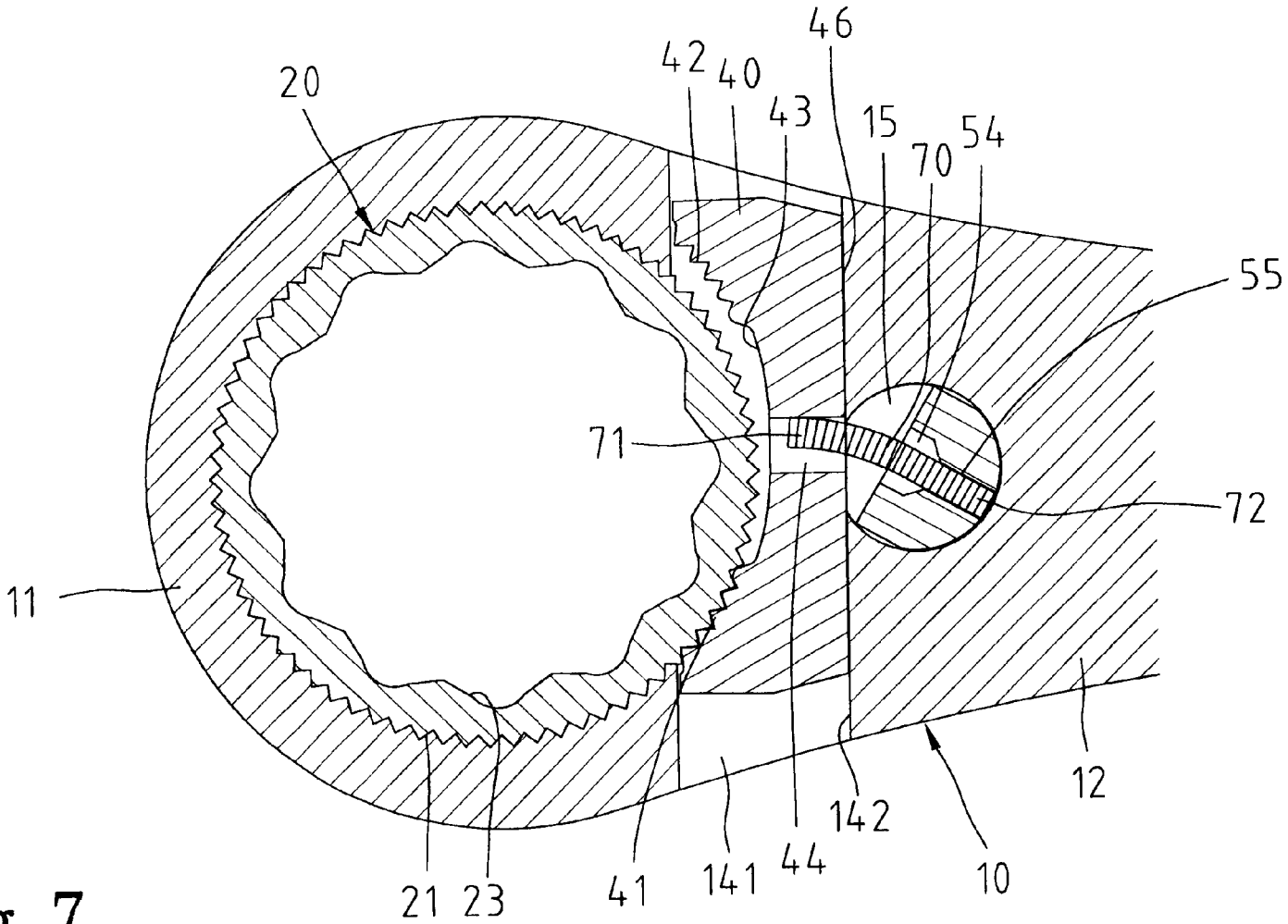
FIG. 7 is a view similar to FIG. 4, wherein the switch member is in a position for ratcheting in a reverse direction.

Referring to FIG. 6, the switch member 50 is pivoted through an angle to engage the ball 62 with the first positioning recess 151 of the switch member 50. The first end 71 of the biasing member 70 bears against an upper wall defining the transverse hole 44 of the pawl 40, as shown in FIG. 7. The biasing member 70 exerts a force to the pawl 40 that can be imparted into a horizontal force parallel to the lengthwise direction of the pawl 40 and a vertical force that is normal to the horizontal force. If the handle 12 is turned counterclockwise, the drive member 20 is firmly engaged with the first toothed portion 41 of the pawl 40 under the action of the vertical force, thereby tightening or loosening the fastener engaged in the polygonal inner periphery 23 of the driver member 20. Again, a higher torque is provided, as the drive member 20 is firmly engaged with and in intimate contact with the first toothed portion 41 of the pawl 40. In addition, the force transmitted to the pawl 40 from the drive member 20 is distributed to the inner longitudinal wall 142 of the transverse through-hole 14 having a relatively large area. As a result, the wrench in accordance with the present invention may bear higher torque. The drive member 20 rotates freely when the handle 12 is turned clockwise. It is noted that the pawl 40 will not protrude beyond the transverse through-hole 14. Inadvertent switching in the ratcheting direction is avoided.

In the first-mentioned embodiment, the first and second positioning recesses 151 and 152 can be processed by any conventional milling or drilling machine. The assembly procedure can be achieved easily and quickly by means of a C-clip 30, no screw or cover is required. In addition, the switch member 50 can be retained in place without any other retaining device.

Figure 8:
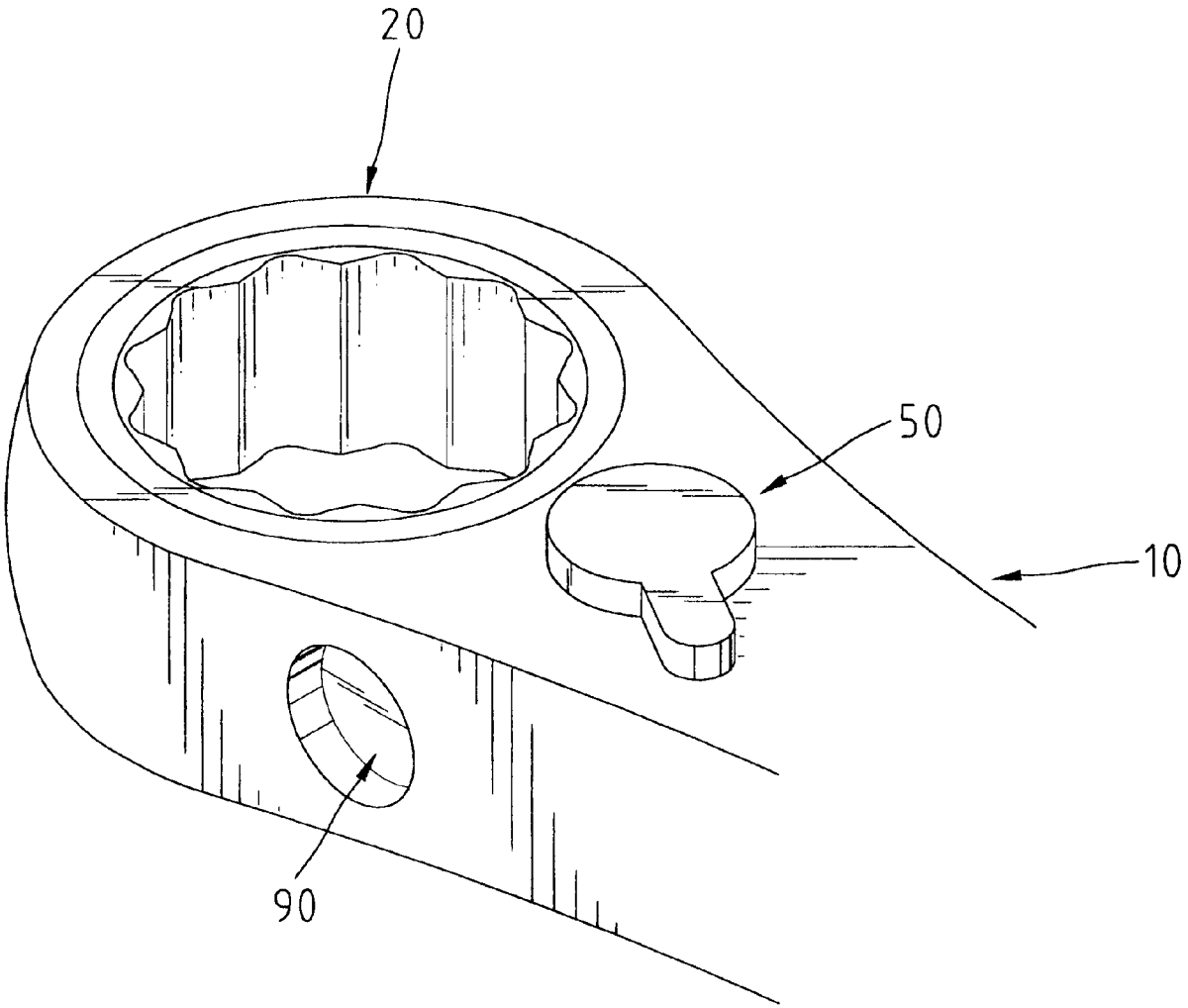
FIG. 8 is a perspective view of a portion of a modified embodiment of the wrench in accordance with the present invention.
Figure 9:
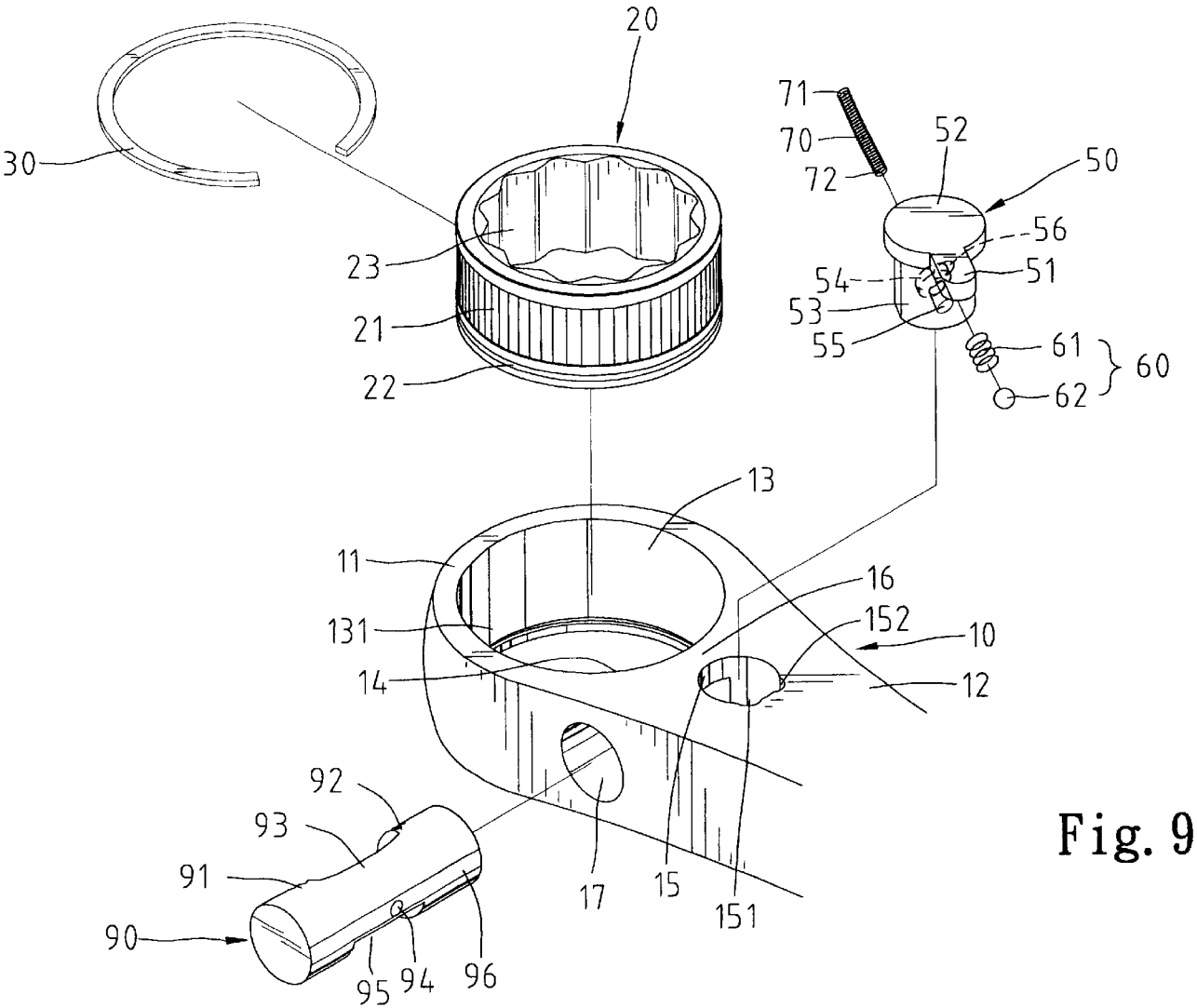
FIG. 9 is an exploded perspective view of the portion of the wrench in FIG. 8.
Figure 10:
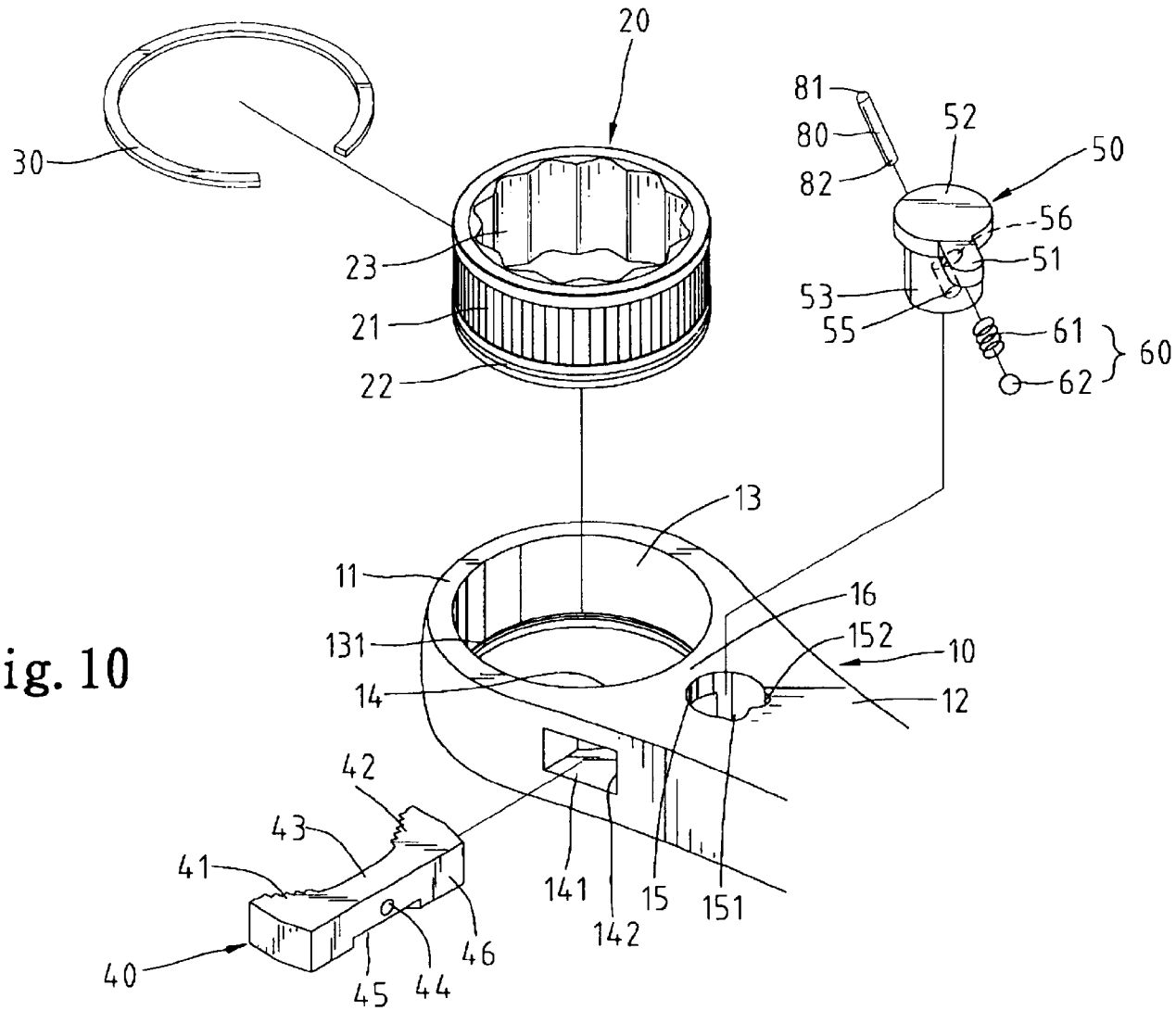
FIG. 10 is an exploded perspective view of a portion of another modified embodiment of the wrench in accordance with the present invention.
Figure 11:
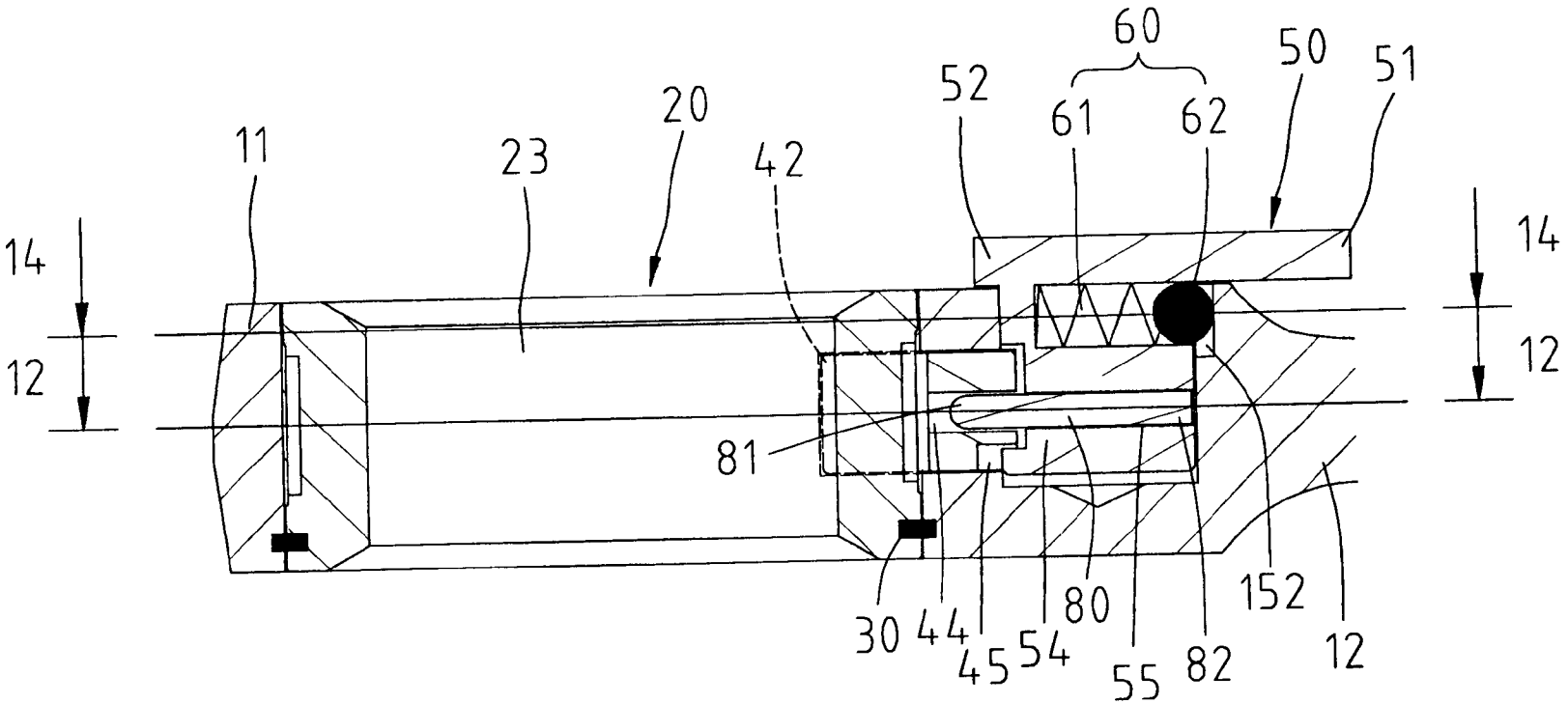
FIG. 11 is a sectional view of the portion of the wrench in FIG. 10.
Figure 12:
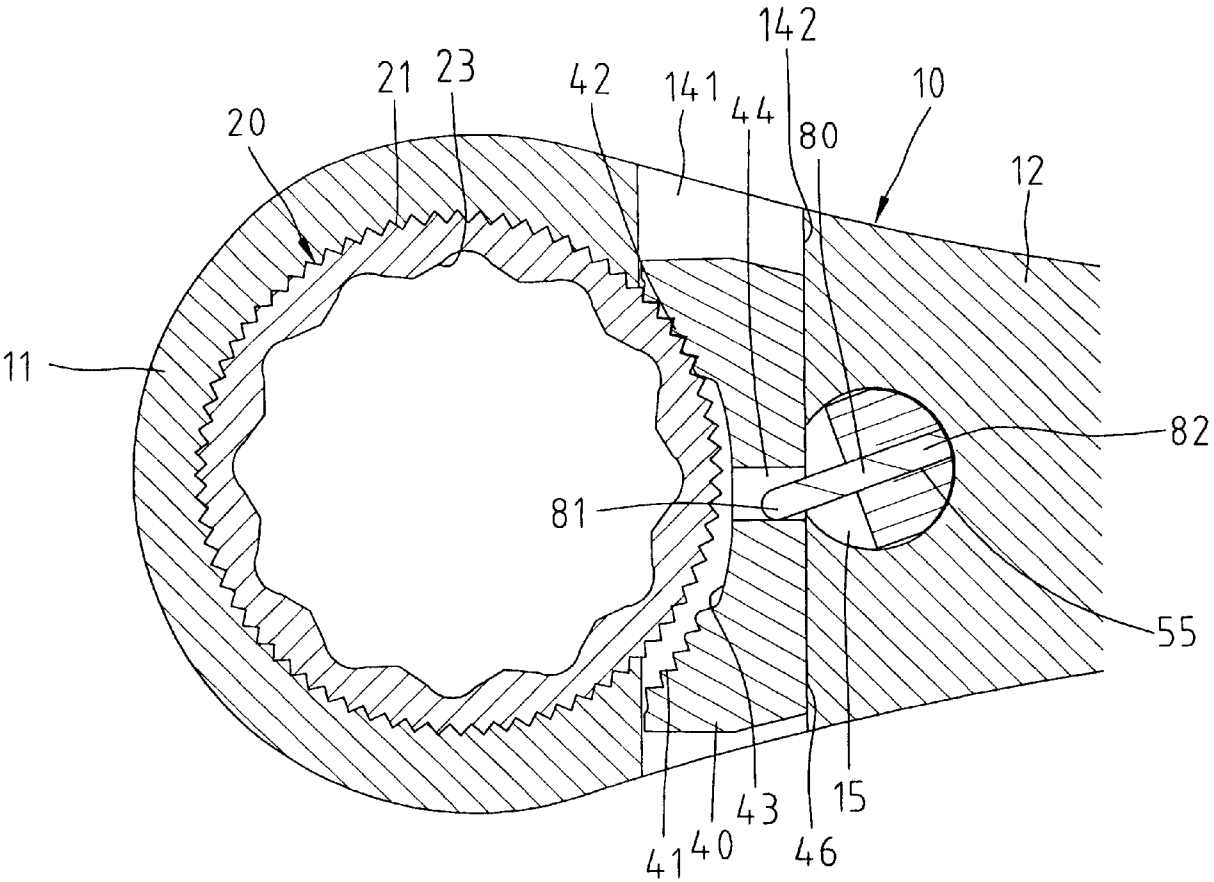
FIG. 12 is a sectional view taken along line 12—12 in FIG. 11
Figure 13:
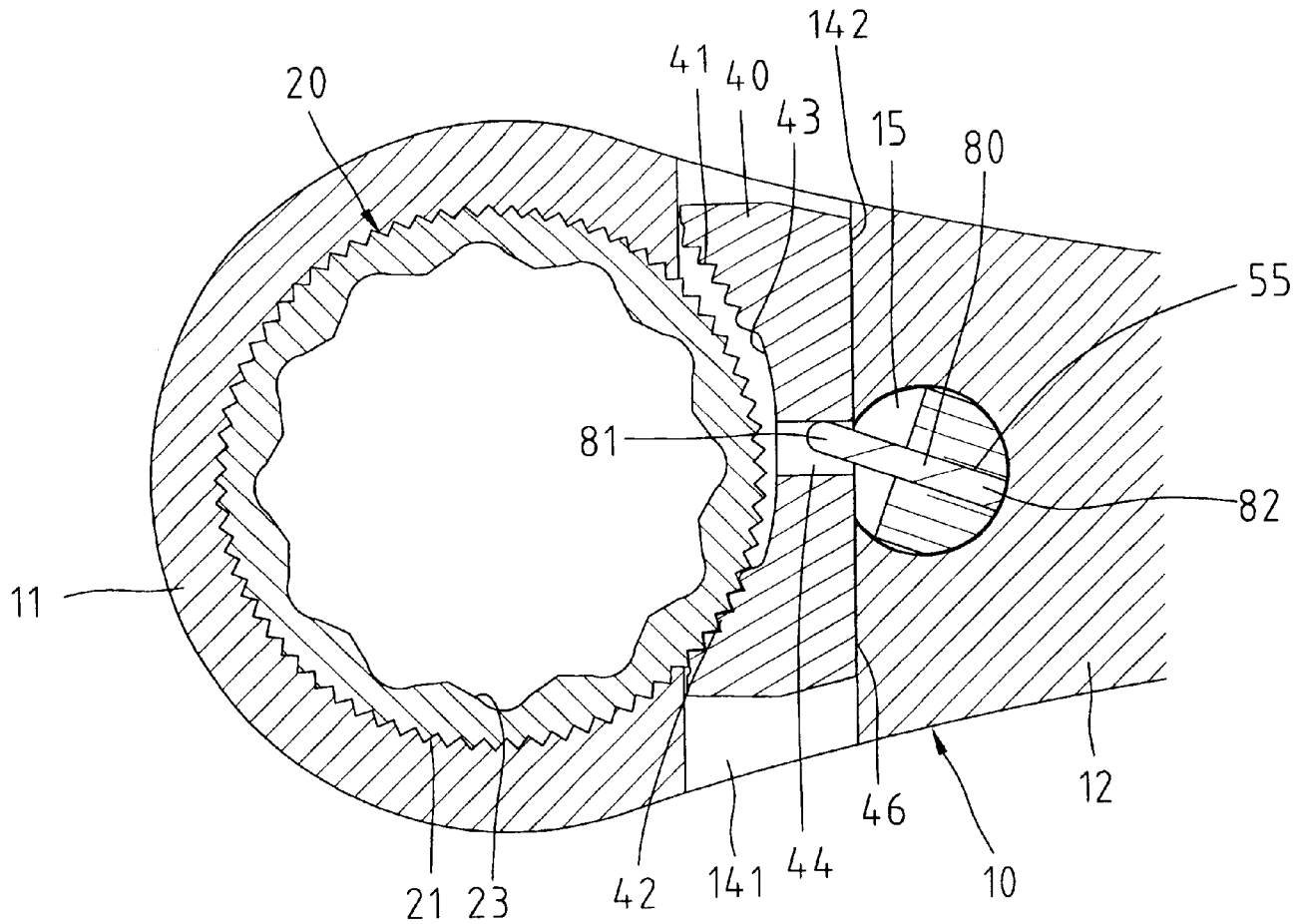
FIG. 13 is a sectional view similar to FIG. 12, wherein the switch member is in a position for ratcheting in a reverse direction.
Figure 14:
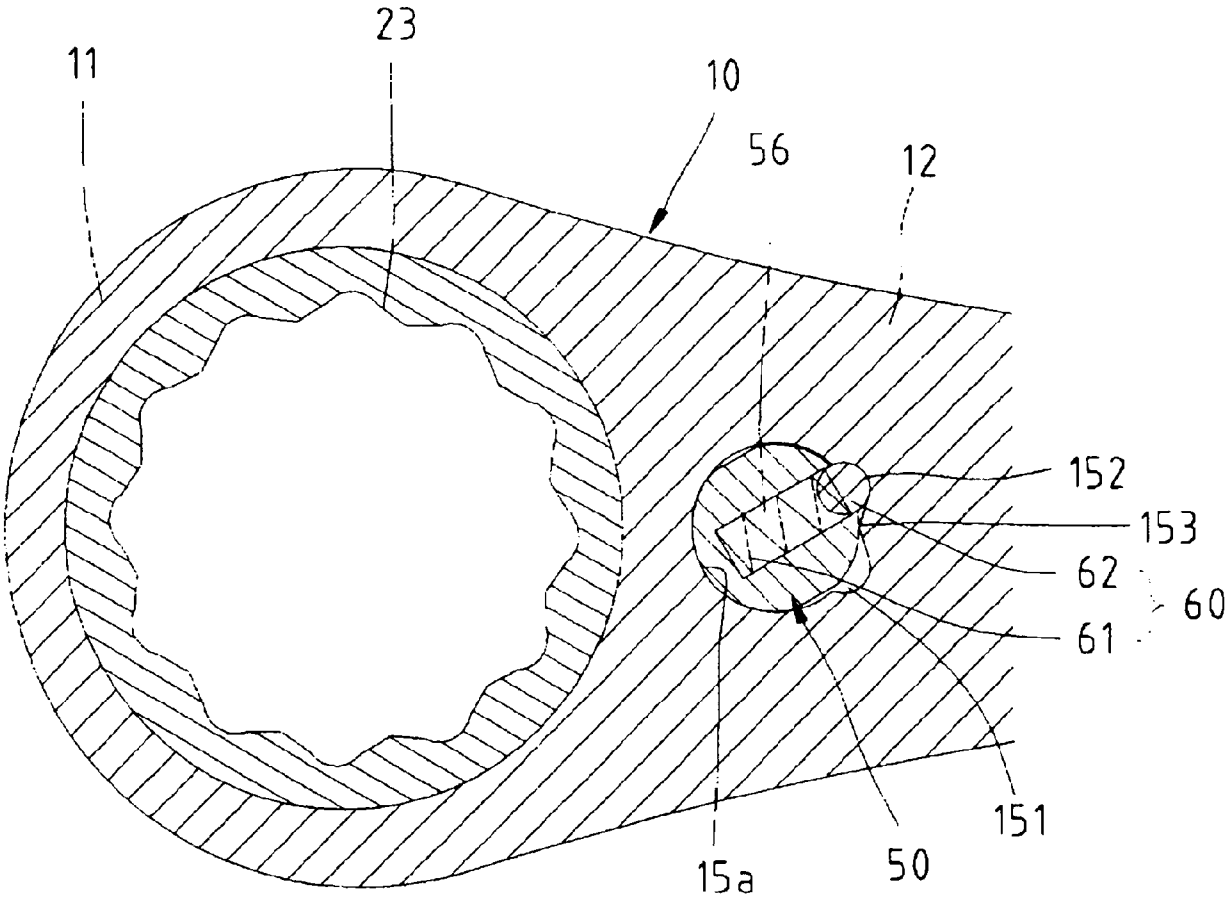
FIG. 14 is a sectional view taken along line 14—14 in FIG. 11.
Figure 15:
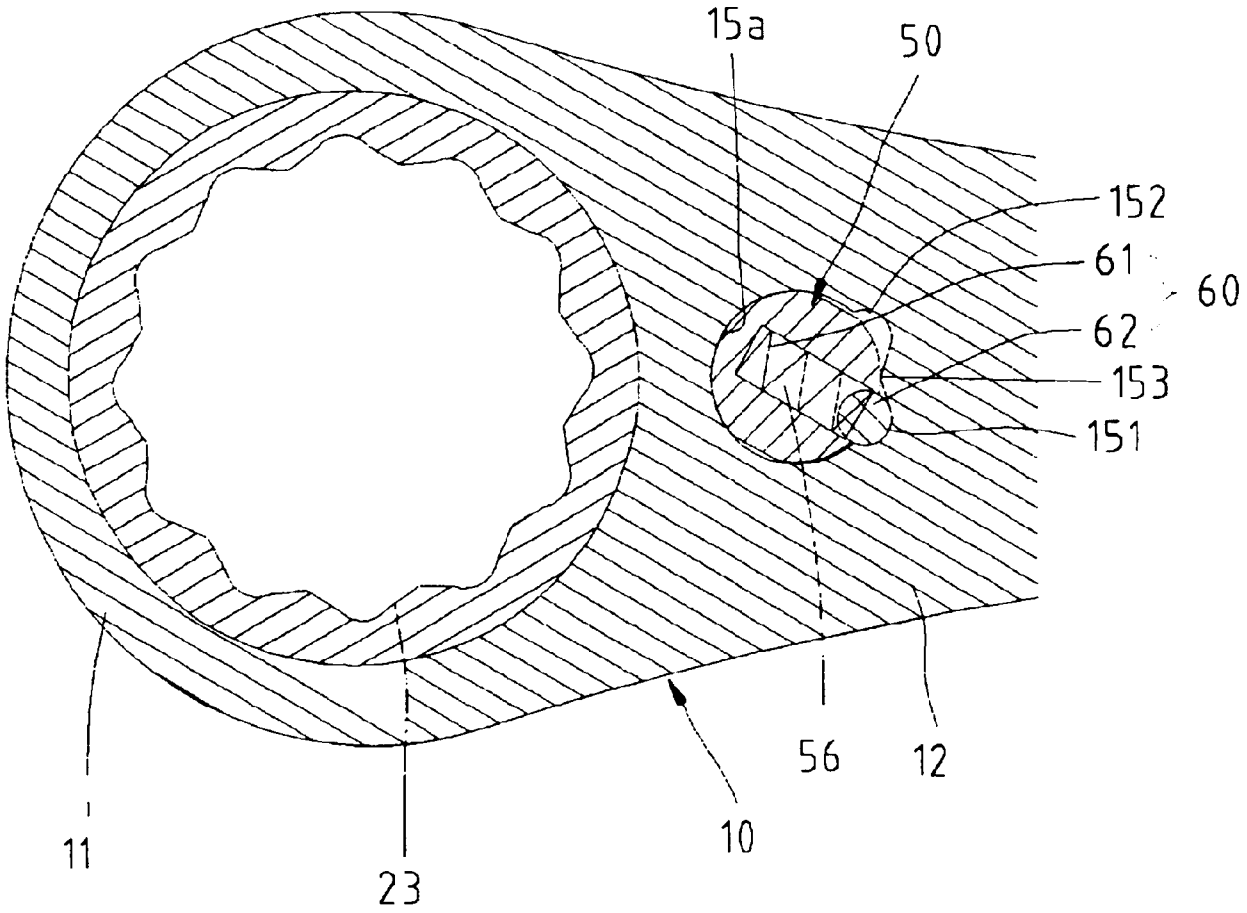
FIG. 15 is a sectional view similar to FIG. 14, wherein the switch member is in a position for ratcheting in a reverse direction.
Figure 16:
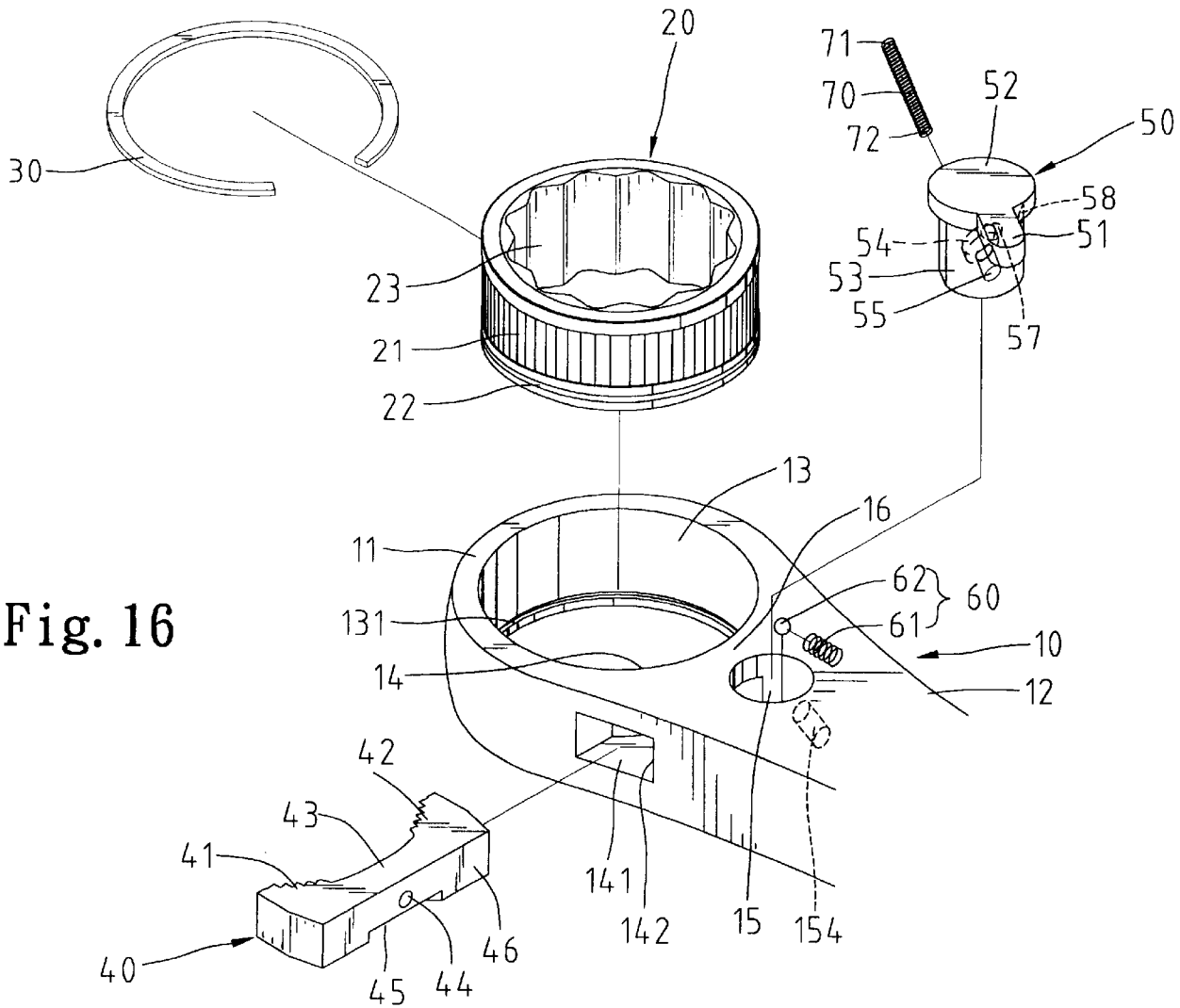
FIG. 16 is an exploded perspective view of a portion of a further modified embodiment of the wrench in accordance with the present invention.

FIGS. 8 and 9 illustrate a modified embodiment of the wrench in accordance with the present invention, the difference between this embodiment and the first embodiment is that the transverse through-hole (now designated by 17) is cylindrical, and the pawl (now designated by 90) is substantially cylindrical. The pawl 90 includes a first side having a first toothed portion 91, a second toothed portion 92, and a recessed portion 93 between the first toothed portion 91 and the second toothed portion 92. The pawl 90 further includes a second side 96 having a notch 95 defined in a lower end thereof. A transverse hole 94 is defined in an intermediate portion of the pawl 90 for receiving the first end 71 of the biasing member 70. Other structure and operation of the wrench are identical to those of the first embodiment.

FIGS. 10 through 15 illustrate another embodiment modified from the first embodiment. The difference between this embodiment and the first embodiment is that the biasing member 70 in the first embodiment is replaced by a rigid pin 80 having a first end 81 and a second end 82. Structure and operation of this embodiment are identical to those of the first embodiment, except that the pin 80 is more rigid than the biasing member 70 in the form of a coil spring.

Figure 17:
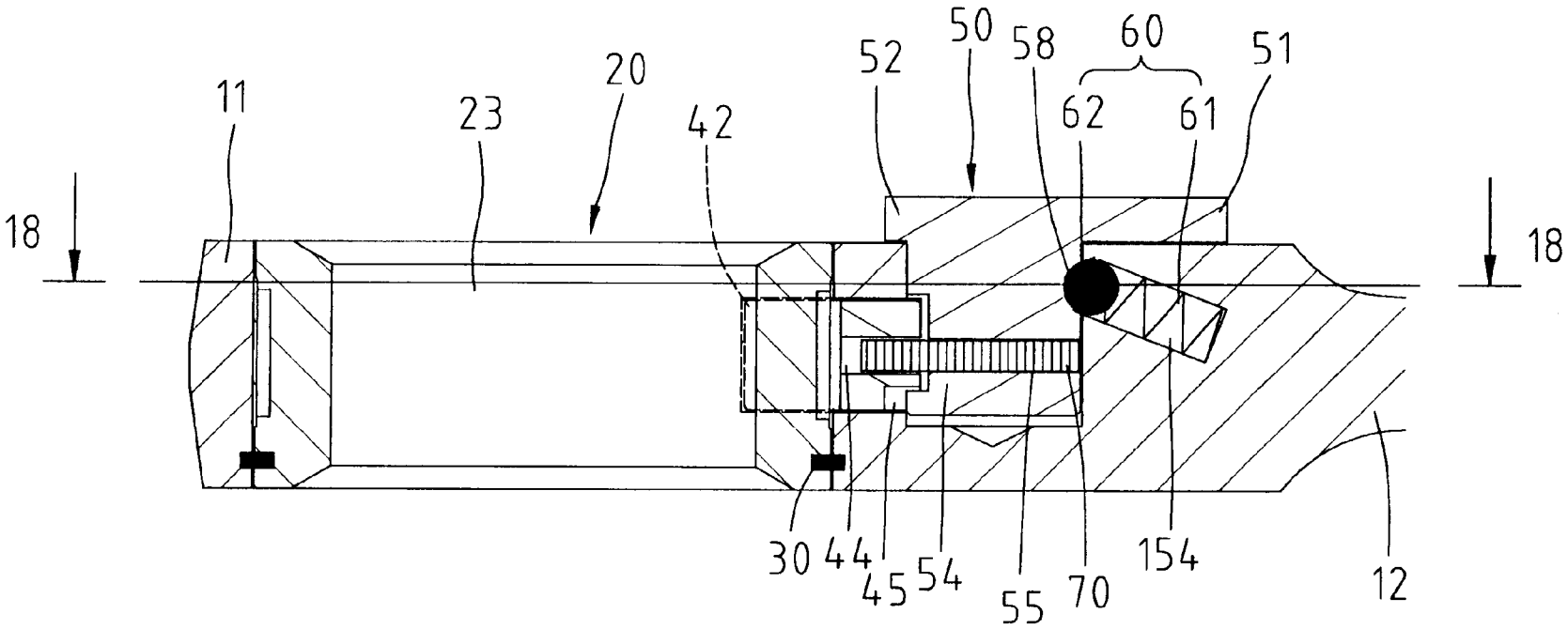
FIG. 17 is a sectional view of the portion of the wrench in FIG. 16.
Figure 18:
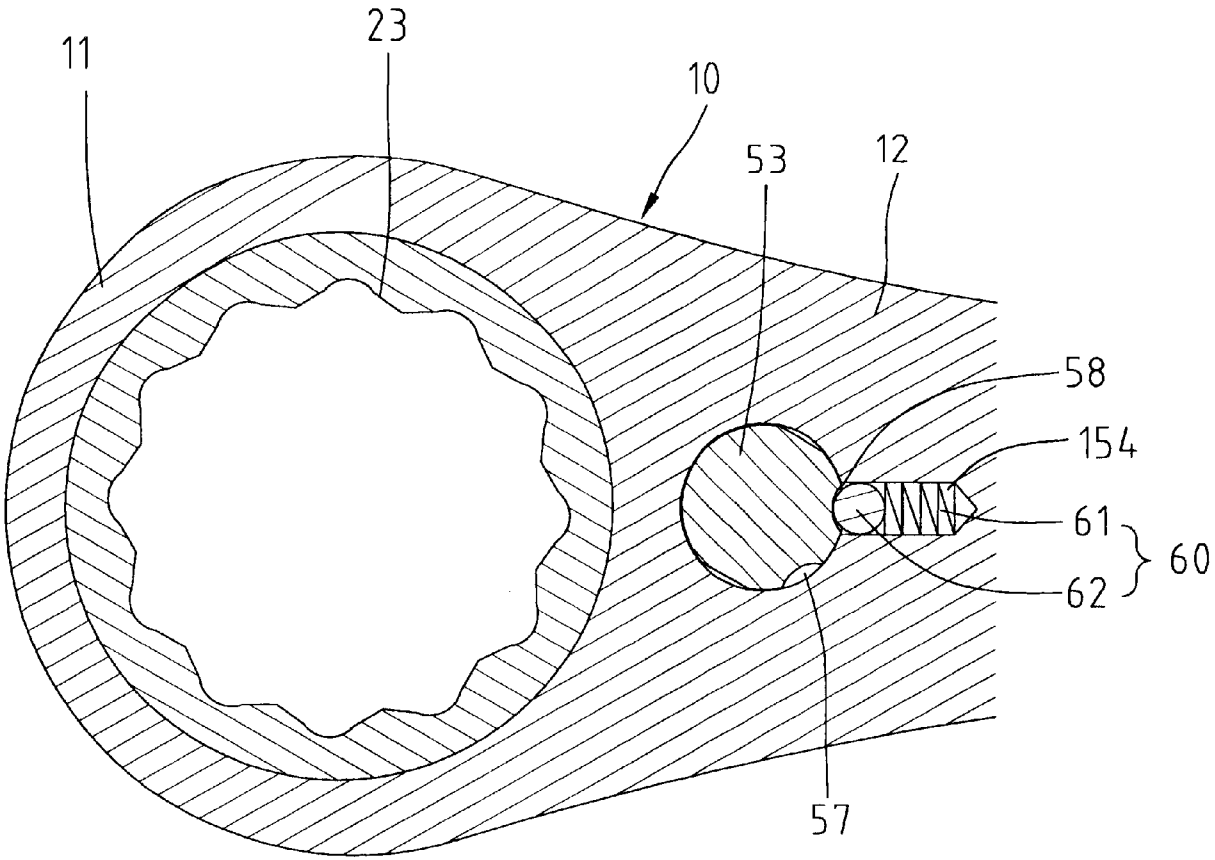
FIG. 18 is a sectional view taken along line 18—18 in FIG. 17.
Figure 19:
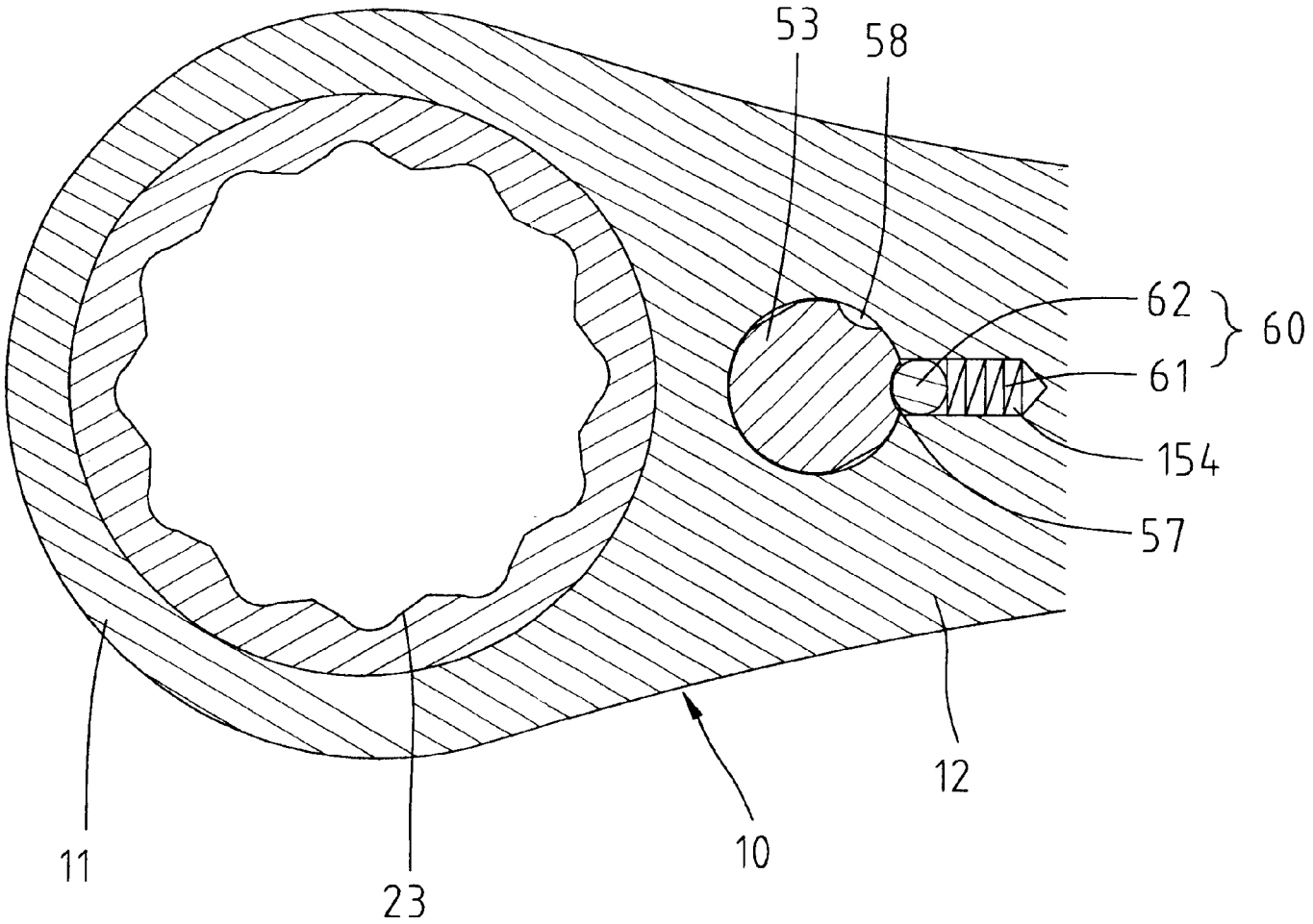
FIG. 19 is a sectional view similar to FIG. 18, wherein the switch member is in a position for ratcheting in a reverse direction.
Figure 20:
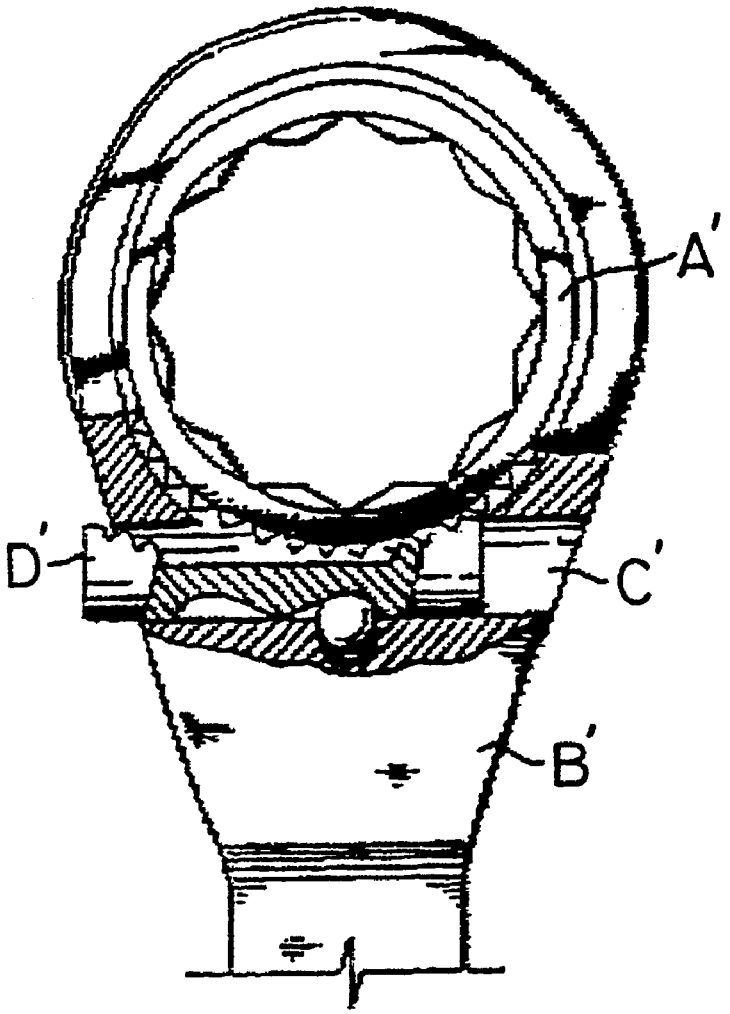
Fig. 20 PRIOR ART
FIG. 20 is a top view, partly sectioned, of a portion of a conventional wrench.
Figure 21:
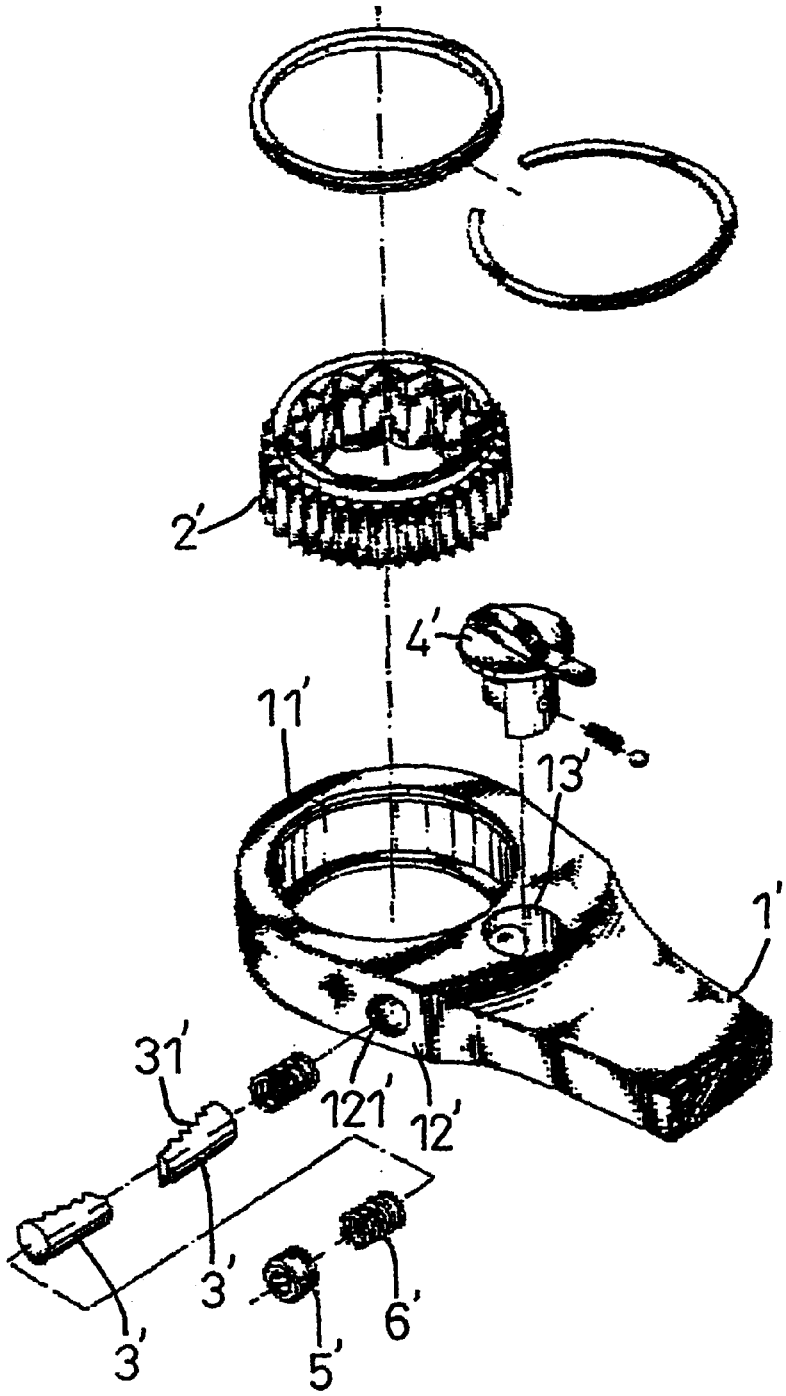
Fig. 21 PRIOR ART
FIG. 21 is an exploded view of a portion of another conventional wrench.
Figure 22:
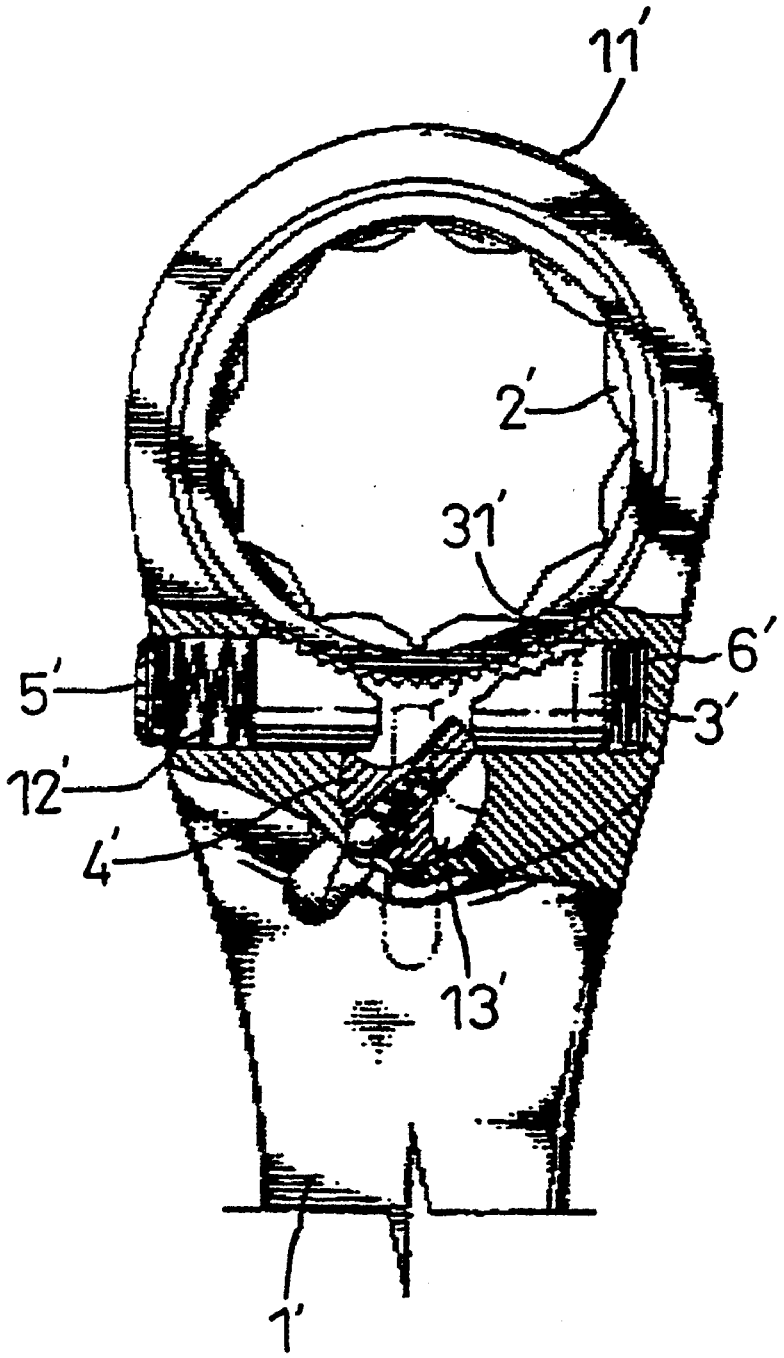
Fig. 22 PRIOR ART
FIG. 22 is a top view, partly sectioned, of the portion of the conventional wrench in FIG. 21.
Figure 23:
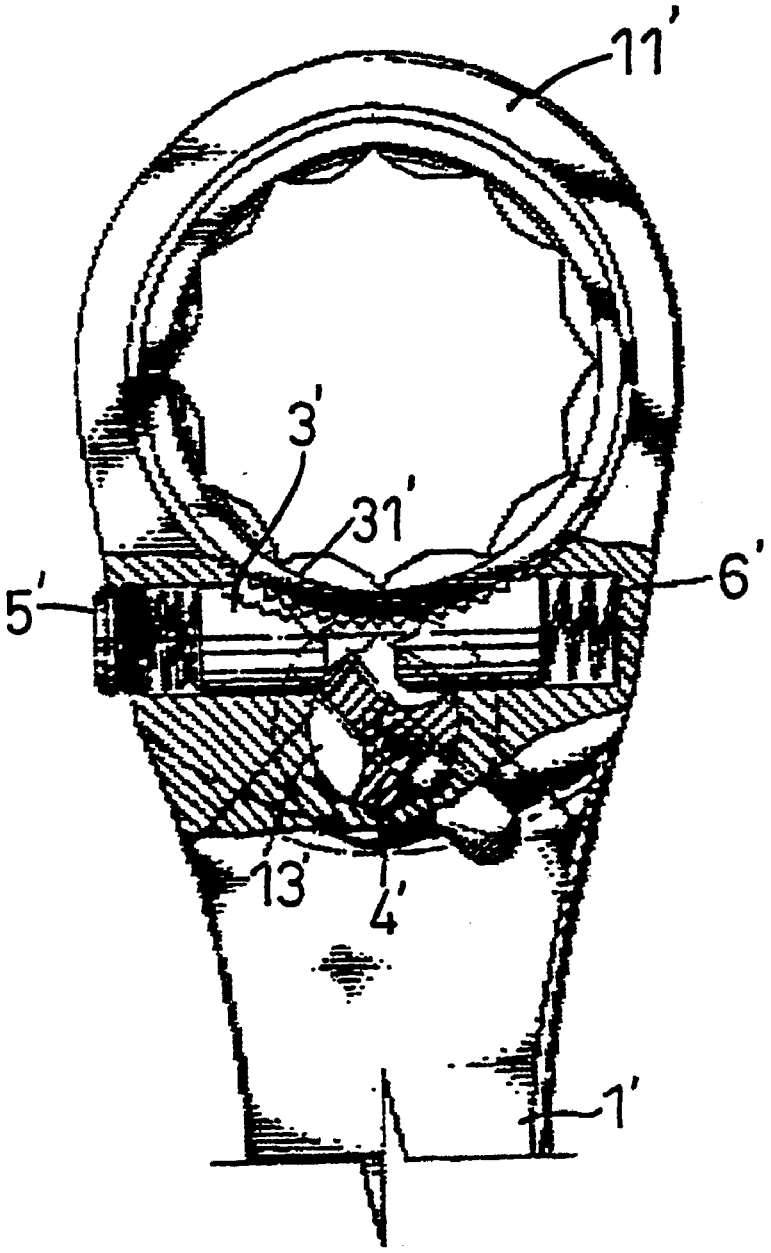
Fig. 23 PRIOR ART
FIG. 23 is a view similar to FIG. 22, wherein the switch member of the wrench is in a position for ratcheting in a reverse direction.
Figure 24:
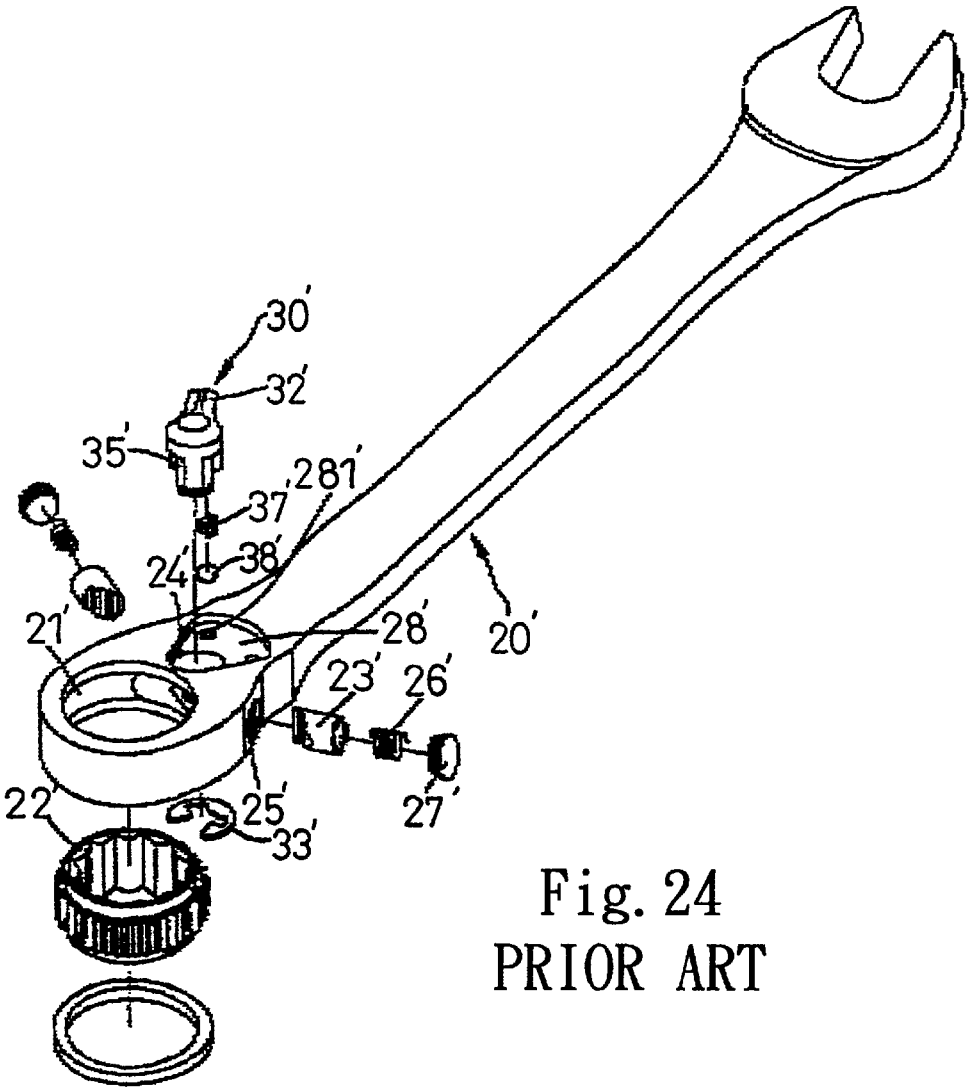
Fig. 24 PRIOR ART
FIG. 24 is an exploded perspective view of a further conventional wrench.
Figure 25:
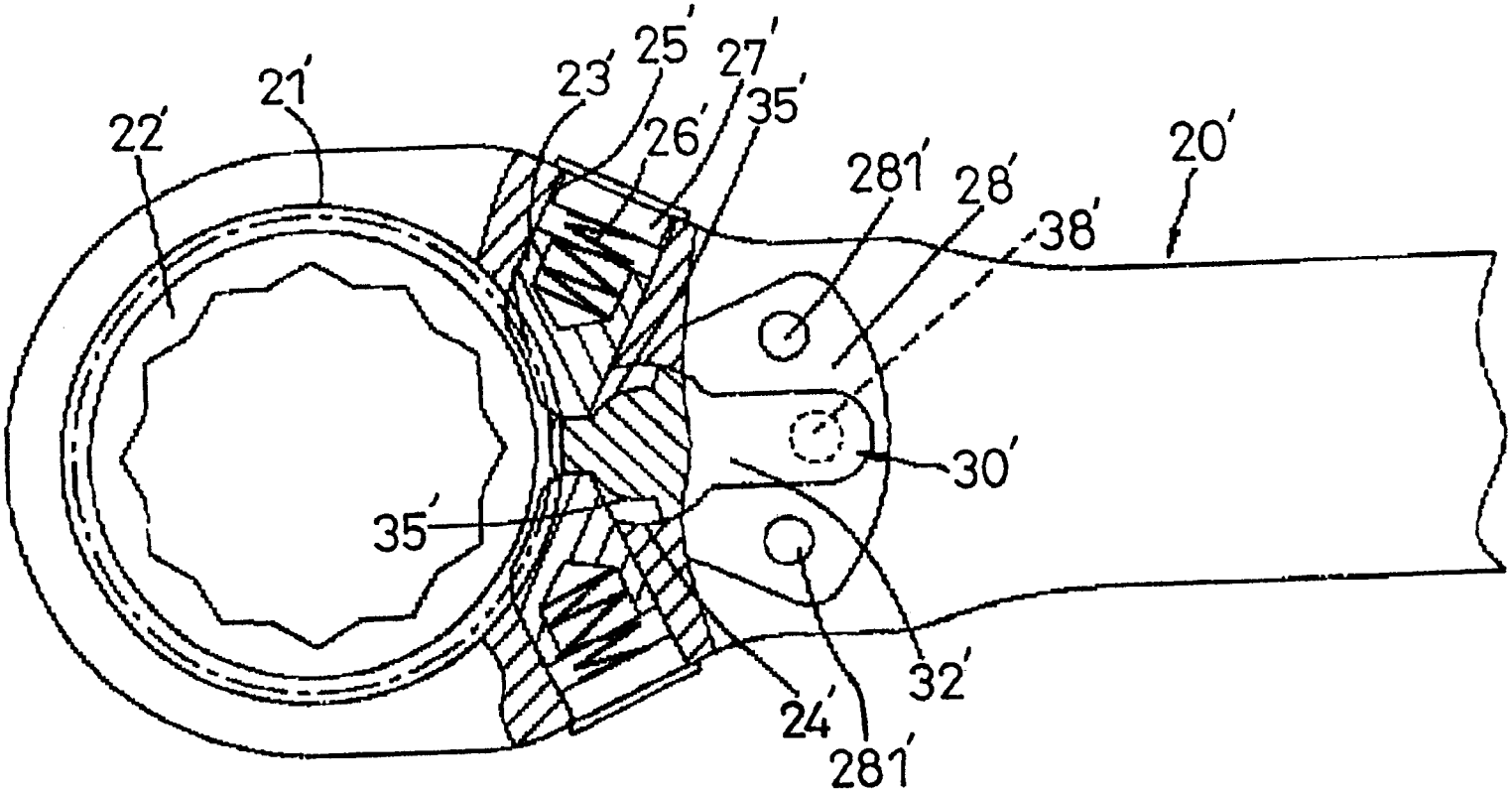
Fig. 25 PRIOR ART
FIG. 25 is a top view, partly sectioned, of a portion of the conventional wrench in FIG. 24.
Figure 26:
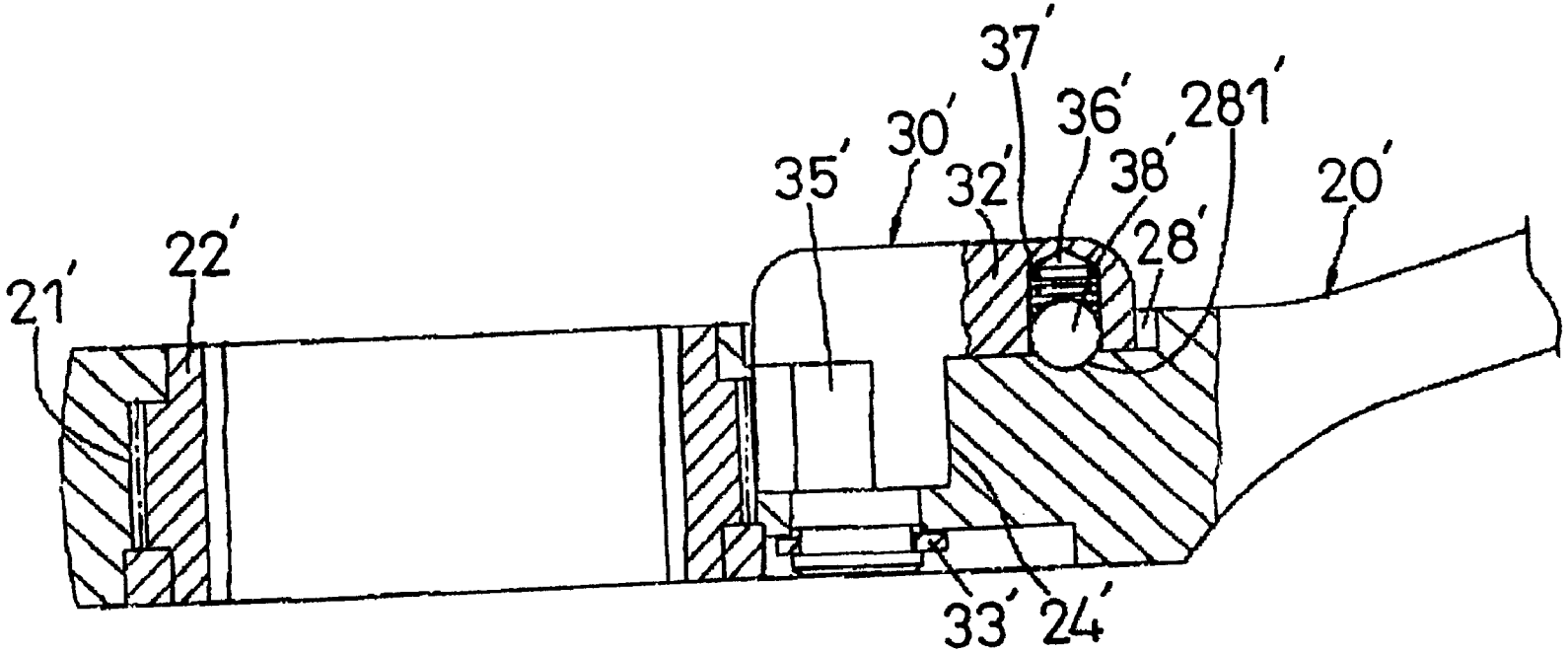
Fig. 26 PRIOR ART
FIG. 26 is a side view, partly sectioned, of the portion of the conventional wrench in FIG. 24.

FIGS. 16 through 19 illustrate a further embodiment modified from the first embodiment. The difference between this embodiment and the first embodiment is that the first and second positioning recesses 151 and 152 in the vertical portion 15*a* of the cavity 15 in the first embodiment are omitted. Instead, an inclined receptacle 154 is defined in the handle 12 and includes an open end facing the vertical portion 15*a* of the cavity 15, best shown in FIG. 17. In addition, the column 53 of the switch member 50 includes a first positioning notch 57 and a second positioning notch 58, best shown in FIG. 18. As illustrated in FIGS. 17 through 19, the ball 62 is biased by the spring 61 to engage with one of the positioning recesses 57 and 58. Other structure and operation of the wrench are identical to those of the first embodiment.

According to the above description, it is appreciated that the wrenches in accordance with the present invention have simple structures and are easy to assemble by using a C-clip 30 without the need of any screws. In addition, the compartment 13, the transverse through-hole 14, 17, and the cavity 15 can be processed by means of milling. No computer lathe is required. Thus, the cost is low, the manufacture process is short, and the production time is also short. Furthermore, the first and second positioning recesses 151 and 152 in the first embodiment and the inclined receptacle 154 in the embodiment illustrated in FIGS. 16 through 19 can be processed by means of milling, which is easy to manufacture. Furthermore, the pawl 40, 90 will not protrude beyond the transverse through-hole 14, 17. Inadvertent switching of the ratcheting direction is avoided. Further, the drive member 20 is firmly engaged with and in intimate contact with the associated toothed portion 41, 42, 91, 92 of the pawl 40, 90 during ratcheting. The risk of slippage or so-called "teeth jump" is avoided. The second side 46, 96 of the pawl 40, 90 contacts with the inner longitudinal wall 142 of the transverse through-hole 14, 17 by a larger area such that the wrench in accordance with the present invention may bear a higher torque. This also prevents inadvertent relative displacement between the biasing member 70 and the pawl 40, 90. The biasing member 70 in the form of a coil spring provides smooth switching of the switch member 50, while the rigid pin 80 provides an alternative option for the user. Further, a bridge 16 is provided between the compartment 13 and the cavity 15, which increases the strength of the wrench, thereby providing a higher torque-bearing capacity. Further, the lower portion of the column 53 extends into the notch 45, 95 of the pawl 40, 90. Disengagement of the switch member 50 from the cavity 15 is prevented without using any additional elements.

Although the invention has been explained in relation to its preferred embodiment, it is to be understood that many other possible modifications and variations can be made without departing from the scope of the invention as hereinafter claimed.

What is claimed is:

1. A wrench comprising:

a handle;

a head extended from the handle, a web being defined between the handle and the head, the head including a first compartment, the web including a second compartment communicated with the first compartment, a cavity being defined in the web and communicated with the second compartment;

a drive member rotatably mounted in the first compartment of the head and including a plurality of teeth on an outer periphery thereof;

a switch member mounted in the cavity and rotatable relative to the handle between two positions corresponding to two opposite ratcheting directions of the handle; and a pawl slidably mounted in the second compartment, the pawl including a first side facing the first compartment and a second side facing away from the first compartment, the first side of the pawl including a first toothed portion and a second toothed portion that are selectively engaged with the teeth of the drive member according to one of the positions of the switch member relative to the handle, the second side of the pawl including a notch, the switch member having a portion extending into the notch of the pawl, thereby preventing disengagement of the switch member from the cavity.

2. The wrench as claimed in claim 1, wherein the handle includes an upper side, the cavity including a vertical portion extending to the upper side of the handle, the switch member including an enlarged head located outside the vertical portion of the cavity, a thumb piece extending radially outward from the enlarged head for manual operation by a user to move the switch member between the two positions, and a column extending downward from the enlarged head and rotatably received in the vertical portion of the cavity.

3. The wrench as claimed in claim 1, wherein the handle includes a first lateral side and a second lateral side opposite to the first lateral side, the second compartment of the web being a transverse hole extending from the first lateral side and extending between the first lateral side and the second lateral side of the handle.

4. The wrench as claimed in claim 3, wherein an inner periphery defining the compartment includes an annular groove in a lower end thereof, the outer periphery of the drive member including an annular groove in a lower end thereof, with the wrench further comprising a C-clip engaged in the annular groove of the compartment and the annular groove of the drive member, thereby rotatably mounting the drive member in the compartment.

5. The wrench as claimed in claim 4, wherein the handle includes an upper side, the cavity including a vertical portion extending to the upper side of the handle, the switch member including an enlarged head located outside the vertical portion of the cavity, a thumb piece extending radially outward from the enlarged head for manual operation by a user to move the switch member between the two positions, and a column extending downward from the enlarged head and rotatably received in the vertical portion of the cavity.

6. The wrench as claimed in claim 5, wherein the pawl includes a transverse hole in an intermediate portion thereof, the column of the switch member including a receptacle facing the transverse hole of the pawl, with the wrench further comprising a biasing member having a first end retained in the transverse hole of the pawl and a second end retained in the receptacle, the biasing member biasing one of the first toothed portion and the second toothed portion of the pawl to engage with the teeth of the drive member.

7. The wrench as claimed in claim 3, wherein the handle includes an upper side, the cavity including a vertical portion extending to the upper side of the handle, the switch member including an enlarged head located outside the vertical portion of the cavity, a thumb piece extending radially outward from the enlarged head for manual operation by a user to move the switch member between the two positions, and a column extending downward from the enlarged head and rotatably received in the vertical portion of the cavity.

8. The wrench as claimed in claim 7, wherein the pawl includes a transverse hole in an intermediate portion thereof, the column of the switch member including a receptacle facing the transverse hole of the pawl, with the wrench further comprising a biasing member having a first end retained in the transverse hole of the pawl and a second end retained in the receptacle, the biasing member biasing one of the first toothed portion and the second toothed portion of the pawl to engage with the teeth of the drive member.

9. The wrench as claimed in claim 8, wherein the biasing member is a coil spring.

10. The wrench as claimed in claim 9, wherein the transverse hole of the pawl is defined by two opposite walls, the first end of the coil spring bears against one of the opposite walls.

11. The wrench as claimed in claim 10, wherein the column of the switch member further includes a second receptacle, the vertical portion of the cavity including a first positioning recess and a second positioning recess, with the wrench further comprising a spring mounted in the second receptacle and a ball biased by the spring to engage with one of the first positioning recess and the second positioning recess.

12. The wrench as claimed in claim 11, wherein the second receptacle of the column is located at a level higher than that of the receptacle receiving the second end of the biasing member.

* * * * *